US008027477B2

(12) United States Patent
Wang

(10) Patent No.: US 8,027,477 B2
(45) Date of Patent: Sep. 27, 2011

(54) SYSTEMS AND METHODS FOR AUDIO PROCESSING

(75) Inventor: Wen Wang, Cupertino, CA (US)

(73) Assignee: SRS Labs, Inc., Santa Ana, CA (US)

( * ) Notice: Subject to any disclaimer, the term of this patent is extended or adjusted under 35 U.S.C. 154(b) by 1150 days.

(21) Appl. No.: 11/531,624

(22) Filed: Sep. 13, 2006

(65) Prior Publication Data

US 2007/0061026 A1 Mar. 15, 2007

Related U.S. Application Data

(60) Provisional application No. 60/716,588, filed on Sep. 13, 2005.

(51) Int. Cl.
*H04R 5/00* (2006.01)
*H04R 5/02* (2006.01)
*H04R 1/00* (2006.01)

(52) U.S. Cl. ..... 381/17; 381/310

(58) Field of Classification Search ..... 381/17, 381/18, 303, 307, 309, 310, 27, 74, 63
See application file for complete search history.

(56) References Cited

U.S. PATENT DOCUMENTS 4,817,149 A * 3/1989 Myers ..... 381/17
4,819,269 A 4/1989 Klayman
4,836,329 A 6/1989 Klayman
4,841,572 A 6/1989 Klayman
4,866,774 A 9/1989 Klayman
5,033,092 A 7/1991 Sadaie
5,319,713 A 6/1994 Waller, Jr. et al.
5,333,201 A 7/1994 Waller, Jr.
5,438,623 A 8/1995 Begault
5,491,685 A 2/1996 Klein et al.
5,581,618 A 12/1996 Satoshi et al.
5,592,588 A 1/1997 Reekes et al.
5,638,452 A 6/1997 Waller, Jr.

(Continued)

FOREIGN PATENT DOCUMENTS

CN 1294782 A 5/2001

(Continued)

OTHER PUBLICATIONS

Vodafone Group, *Vodafone VFX Specification, Version 1.1.2*., Sep. 10, 2004, pp. 1-134, Vodafone House The Connection, Newbury RG14 2FN England.

(Continued)

*Primary Examiner* — Ping Lee
(74) *Attorney, Agent, or Firm* — Knobbe Martens Olson & Bear LLP

(57) ABSTRACT

Systems and methods for audio signal processing are disclosed, where a discrete number of simple digital filters are generated for particular portions of an audio frequency range. Studies have shown that certain frequency ranges are particularly important for human ears' location-discriminating capability, while other ranges are generally ignored. Head-Related Transfer Functions (HRTFs) are examples response functions that characterize how ears perceive sound positioned at different locations. By selecting one or more "location-critical" portions of such response functions, one can construct simple filters that can be used to simulate heating where location-discriminating capability is substantially maintained. Because the filters can be simple, they can be implemented in devices having limited computing power and resources to provide location-discrimination responses that form the basis for many desirable audio effects.

7 Claims, 18 Drawing Sheets

U.S. PATENT DOCUMENTS

| | | | | |
|---|---|---|---|---|
| 5,661,808 | A | 8/1997 | Klayman | |
| 5,742,689 | A * | 4/1998 | Tucker et al. | 381/17 |
| 5,771,295 | A | 6/1998 | Waller, Jr. | |
| 5,784,468 | A | 7/1998 | Klayman | |
| 5,809,149 | A | 9/1998 | Cashion et al. | |
| 5,835,895 | A | 11/1998 | Stokes, III | |
| 5,850,453 | A | 12/1998 | Klayman et al. | |
| 5,896,456 | A | 4/1999 | Desper | |
| 5,912,976 | A | 6/1999 | Klayman et al. | |
| 5,943,427 | A * | 8/1999 | Massie et al. | 381/17 |
| 5,946,400 | A | 8/1999 | Matsuo | |
| 5,970,152 | A | 10/1999 | Klayman | |
| 5,974,152 | A | 10/1999 | Fujinami | |
| 5,995,631 | A | 11/1999 | Kamada et al. | |
| 6,078,669 | A | 6/2000 | Maher | |
| 6,091,824 | A | 7/2000 | Lin et al. | |
| 6,108,626 | A | 8/2000 | Cellario et al. | |
| 6,118,875 | A | 9/2000 | Moller | |
| 6,195,434 | B1 | 2/2001 | Cashion et al. | |
| 6,281,749 | B1 | 8/2001 | Klayman et al. | |
| 6,285,767 | B1 | 9/2001 | Klayman | |
| 6,307,941 | B1 | 10/2001 | Tanner, Jr. et al. | |
| 6,385,320 | B1 | 5/2002 | Lee | |
| 6,421,446 | B1 * | 7/2002 | Cashion et al. | 381/17 |
| 6,504,933 | B1 | 1/2003 | Chung | |
| 6,553,121 | B1 | 4/2003 | Matsuo et al. | |
| 6,557,736 | B1 | 5/2003 | Ophardt | |
| 6,590,983 | B1 | 7/2003 | Kraemer | |
| 6,741,706 | B1 | 5/2004 | McGrath et al. | |
| 6,839,438 | B1 | 1/2005 | Riegelsberger et al. | |
| 6,993,480 | B1 | 1/2006 | Klayman | |
| 7,031,474 | B1 | 4/2006 | Yuen et al. | |
| 7,043,031 | B2 | 5/2006 | Klayman et al. | |
| 7,277,767 | B2 | 10/2007 | Yuen et al. | |
| 7,451,093 | B2 | 11/2008 | Kraemer | |
| 7,680,288 | B2 | 3/2010 | Melchior et al. | |
| 2001/0040968 | A1 | 11/2001 | Mukojima | |
| 2002/0034307 | A1 | 3/2002 | Kubota | |
| 2002/0038158 | A1 | 3/2002 | Hashimoto et al. | |
| 2002/0097880 | A1 | 7/2002 | Kirkeby | |
| 2002/0161808 | A1 | 10/2002 | Kamiya et al. | |
| 2002/0196947 | A1 | 12/2002 | Lapicque | |
| 2004/0196991 | A1 | 10/2004 | Iida et al. | |
| 2004/0247132 | A1 | 12/2004 | Klayman et al. | |
| 2005/0117762 | A1 | 6/2005 | Sakurai | |
| 2005/0171989 | A1 | 8/2005 | Koyanagi | |
| 2005/0273324 | A1 | 12/2005 | Yi | |
| 2007/0061026 | A1 | 3/2007 | Wang | |
| 2009/0237564 | A1 | 9/2009 | Kikinis et al. | |
| 2009/0326960 | A1 | 12/2009 | Breebaat | |
| 2010/0135510 | A1 | 6/2010 | Yoo et al. | |

FOREIGN PATENT DOCUMENTS

| | | | |
|---|---|---|---|
| CN | 1706100 | A | 12/2005 |
| EP | 1320281 | A2 | 6/2003 |
| EP | 1 617 707 | A2 | 1/2006 |
| JP | 3208529 | B2 | 9/2001 |
| JP | 3686989 | | 6/2005 |
| WO | WO 98/20709 | | 5/1998 |
| WO | WO 99/14983 | | 3/1999 |
| WO | WO 2005/048653 | A1 | 5/2005 |
| WO | WO 2007/033150 | | 3/2007 |
| WO | WO 2007/123788 | | 11/2007 |
| WO | WO 2008/035275 | | 3/2008 |
| WO | WO 2008/084436 | | 7/2008 |

OTHER PUBLICATIONS

JSR-234 Exper Group, *Advanced Multimedia Supplements API for Java™ 2 Micro Edition*, May 17, 2005, pp. 1-200, Appendix, Nokia Corporation.

Orfanidis, Sophocles, J. *Introduction to Signal Processing*, 1996, pp. 168-383, Prentice-Hall, Inc. Upper Saddle River, New Jersey 07458.

Lutfi, Robert A. and Wen Wang, *Correlational analysis of acoustic cues for the discrimination of auditory motion*, J. Acoustical Society of America, Aug. 1999, pp. 919-928, Department of Communicative Disorders and Department of Psychology, University of Wisconsin, Madison.

Wrightman, Frederic L. and Kistler, Doris J., *Headphone simulation of free-field listening. I: Stimulus synthesis*, J. Acoustical Society of America, Feb. 1989, pp. 858-867.

Wrightman, Frederic L. and Kistler, Doris J., *Headphone simulation of free-field listening. II: Psychological validation*, J. Acoustical Society of America, Feb. 1989, pp. 868-878.

Kahrs M, and Brandenbur K., *Applications of Digital Signal Processing to Audio and Acoustics*, 2003, pp. 85-131.

Moore, Richard F., *Elements of Computer Music*, 1990, pp. 362-369 and 370-391, Prentice-Hall, Inc. Englewood Cliffs, New Jersey 07632.

Wang, W., and Lutfi, R.A. *Thresholds for detection of a change in the displacement, velocity, and acceleration of a synthesized sound-emitting source*, Journal of the Acoustical Society of America, 95, p. 2897.

International Search Report and Written Opinion mailed Feb. 20, 2008 regarding International Application No. PCT/US07/08052.

Chinese Office Action, re CN Application No. 200680033693.8, dated Jul. 24, 2009.

EPO Exam Report dated Aug. 10, 2010, re EP App. No. 06 814 495.5.

European Extended Search Report and Opinion re EP 07754557.2 dated Mar. 2, 2010.

MacPherson, E.A. A comparison of spectral correlational and local feature-matching models of pinna cue processing, Journal of the Acoustical Society of America, May 1997, vol. 101, No. 5, p. 3104 (Abstract).

PCT International Search Report and Written Opinion re PCT/US2006/035446, dated Jan. 19, 2007.

Engdegard, et al., "Spatial Audio Object Coding (SAOC)—The Upcoming MPEG Standard on Parametric Object Based Audio Coding", Audio Engineering Society, Convention Paper, Presented at the 124th Convention, May 17-20, 2008, Amsterdam, The Netherlands, 15 pages.

Potard et al., "Using XML Schemas to Created and Encode Interactive 3-D Audio Scenes for Multimedia and Virtual Reality Applications", Whisper Laoratory, University of Wollongong, Austrailia, 11 pages, 2002.

Gatzsche et al., Beyond DCI: The integration of object oriented 3D sound into the Digital Cinema, 25 pages.

Japanese Office Action for corresponding Japanese Patent Application No. 2008-531246, mailed Feb. 10, 2011.

Office Action issued in Chinese patent application No. 200780019630.1 on Jun. 15, 2011.

* cited by examiner

SYSTEMS AND METHODS FOR AUDIO PROCESSING

PRIORITY CLAIM

This application claims the benefit of priority under 35 U.S.C. §119(e) of U.S. Provisional Application No. 60/716,588 filed on Sep. 13, 2005 and titled SYSTEMS AND METHODS FOR AUDIO PROCESSING, the entirety of which is incorporated herein by reference.

BACKGROUND

1. Field

The present disclosure generally relates to audio signal processing, and more particularly, to systems and methods for filtering location-critical portions of audible frequency range to simulate three-dimensional listening effects.

2. Description of the Related Art

Sound signals can be processed to provide enhanced listening effects. For example, various processing techniques can make a sound source be perceived as being positioned or moving relative to a listener. Such techniques allow the listener to enjoy a simulated three-dimensional listening experience even when using speakers having limited configuration and performance.

However, many sound perception enhancing techniques are complicated, and often require substantial computing power and resources. Thus, use of these techniques are impractical or impossible when applied to many electronic devices having limited computing power and resources. Much of the portable devices such as cell phones, PDAs, MP3 players, and the like, generally fall under this category.

SUMMARY

At least some of the foregoing problems can be addressed by various embodiments of systems and methods for audio signal processing as disclosed herein. In one embodiment, a discrete number of simple digital filters can be generated for particular portions of an audio frequency range. Studies have shown that certain frequency ranges are particularly important for human ears' location-discriminating capability, while other ranges are generally ignored. Head-Related Transfer Functions (HRTFs) are examples response functions that characterize how ears perceive sound positioned at different locations. By selecting one or more "location-critical" portions of such response functions, one can construct simple filters that can be used to simulate hearing where location-discriminating capability is substantially maintained. Because the filters can be simple, they can be implemented in devices having limited computing power and resources to provide location-discrimination responses that form the basis for many desirable audio effects.

One embodiment of the present disclosure relates to a method for processing digital audio signals. The method includes receiving one or more digital signals, with each of the one or more digital signals having information about spatial position of a sound source relative to a listener. The method further includes selecting one or more digital filters, with each of the one or more digital filters being formed from a particular range of a hearing response function. The method further includes applying the one or more filters to the one or more digital signals so as to yield corresponding one or more filtered signals, with each of the one or more filtered signals having a simulated effect of the hearing response function applied to the sound source.

In one embodiment, the hearing response function includes a head-related transfer function (HRTF). In one embodiment, the particular range includes a particular range of frequency within the HRTF. In one embodiment, the particular range of frequency is substantially within or overlaps with a range of frequency that provides a location-discriminating sensitivity to an average human's hearing that is greater than an average sensitivity among an audible frequency. In one embodiment, the particular range of frequency includes or substantially overlaps with a peak structure in the HRTF. In one embodiment, the peak structure is substantially within or overlaps with a range of frequency between about 2.5 KHz and about 7.5 KHz. In one embodiment, the peak structure is substantially within or overlaps with a range of frequency between about 8.5 KHz and about 18 KHz.

In one embodiment, the one or more digital signals include left and right digital signals to be output to left and right speakers. In one embodiment, the left and right digital signals are adjusted for interaural time difference (ITD) based on the spatial position of the sound source relative to the listener. In one embodiment, the ITD adjustment includes receiving a mono input signal having information about the spatial position of the sound source. The ITD adjustment further includes determining a time difference value based on the spatial information. The ITD adjustment further includes generating left and right signals by introducing the time difference value to the mono input signal.

In one embodiment, the time difference value includes a quantity that is proportional to absolute value of $\sin\theta \cos\phi$, where $\theta$ represents an azimuthal angle of the sound source relative to the front of the listener, and $\phi$ represents an elevation angle of the sound source relative to a horizontal plane defined by the listener's ears and the front direction. In one embodiment, the quantity is expressed as $|(\text{Maximum_ITD_Samples_per_Sampling_Rate}-1) \sin\theta \cos\phi|$.

In one embodiment, the determination of time difference value is performed when the spatial position of the sound source changes. In one embodiment, the method further includes performing a crossfade transition of the time difference value between the previous value and the current value. In one embodiment, the crossfade transition includes changing the time difference value for use in the generation of left and right signals from the previous value to the current value during a plurality of processing cycles.

In one embodiment, the one or more filtered signals include left and right filtered signals to be output to left and right speakers. In one embodiment, the method further includes adjusting each of the left and right filtered signals for interaural intensity difference (IID) to account for any intensity differences that may exist and not accounted for by the application of one or more filters. In one embodiment, the adjustment of the left and right filtered signals for IID includes determining whether the sound source is positioned at left or right relative to the listener. The adjustment further includes assigning as a weaker signal the left or right filtered signal that is on the opposite side as the sound source. The adjustment further includes assigning as a stronger signal the other of the left or right filtered signal. The adjustment further includes adjusting the weaker signal by a first compensation. The adjustment further includes adjusting the stronger signal by a second compensation.

In one embodiment, the first compensation includes a compensation value that is proportional to $\cos\theta$, where $\theta$ represents an azimuthal angle of the sound source relative to the front of the listener. In one embodiment, the compensation value is normalized such that if the sound source is substantially directly in the front, the compensation value can be an original filter level difference, and if the sound source is substantially directly on the stronger side, the compensation value is approximately 1 so that no gain adjustment is made to the weaker signal.

In one embodiment, the second compensation includes a compensation value that is proportional to sin θ, where θ represents an azimuthal angle of the sound source relative to the front of the listener. In one embodiment, the compensation value is normalized such that if the sound source is substantially directly in the front, the compensation value is approximately 1 so that no gain adjustment is made to the stronger signal, and if the sound source is substantially directly on the weaker side, the compensation value is approximately 2 thereby providing an approximately 6 dB gain compensation to approximately match an overall loudness at different values of the azimuthal angle.

In one embodiment, the adjustment of the left and right filtered signals for IID is performed when new one or more digital filters are applied to the left and right filtered signals due to selected movements of the sound source. In one embodiment, the method further includes performing a crossfade transition of the first and second compensation values between the previous values and the current values. In one embodiment, the crossfade transition includes changing the first and second compensation values during a plurality of processing cycles.

In one embodiment, the one or more digital filters include a plurality of digital filters. In one embodiment, each of the one or more digital signals is split into the same number of signals as the number of the plurality of digital filters such that the plurality of digital filters are applied in parallel to the plurality of split signals. In one embodiment, the each of one or more filtered signals is obtained by combining the plurality of split signals filtered by the plurality of digital filters. In one embodiment, the combining includes summing of the plurality of split signals.

In one embodiment, the plurality of digital filters include first and second digital filters. In one embodiment, each of the first and second digital filters includes a filter that yields a response that is substantially maximally flat in a passband portion and rolls off towards substantially zero in a stopband portion of the hearing response function. In one embodiment, each of the first and second digital filters includes a Butterworth filter. In one embodiment, the passband portion for one of the first and second digital filters is defined by a frequency range between about 2.5 KHz and about 7.5 KHz. In one embodiment, the passband portion for one of the first and second digital filters is defined by a frequency range between about 8.5 KHz and about 18 KHz.

In one embodiment, the selection of the one or more digital filters is based on a finite number of geometric positions about the listener. In one embodiment, the geometric positions include a plurality of hemi-planes, each hemi-plane defined by an edge along a direction between the ears of the listener and by an elevation angle ϕ relative to a horizontal plane defined by the ears and the front direction for the listener. In one embodiment, the plurality of hemi-planes are grouped into one or more front hemi-planes and one or more rear hemi-planes. In one embodiment, the front hemi-planes include hemi-planes at front of the listener and at elevation angles of approximately 0 and +/−45 degrees, and the rear hemi-planes include hemi-planes at rear of the listener and at elevation angles of approximately 0 and +/−45 degrees.

In one embodiment, the method further includes performing at least one of the following processing steps either before the receiving of the one or more digital signals or after the applying of the one or more filters: sample rate conversion, Doppler adjustment for sound source velocity, distance adjustment to account for distance of the sound source to the listener, orientation adjustment to account for orientation of the listener's head relative to the sound source, or reverberation adjustment.

In one embodiment, the application of the one or more digital filters to the one or more digital signals simulates an effect of motion of the sound source about the listener.

In one embodiment, the application of the one or more digital filters to the one or more digital signals simulates an effect of placing the sound source at a selected location about the listener. In one embodiment, the method further includes simulating effects of one or more additional sound sources to simulate an effect of a plurality of sound sources at selected locations about the listener. In one embodiment, the one or more digital signals include left and right digital signals to be output to left and right speakers and the plurality of sound sources include more than two sound sources such that effects of more than two sound sources are simulated with the left and right speakers. In one embodiment, the plurality of sound sources include five sound sources arranged in a manner similar to one of surround sound arrangements, and wherein the left and right speakers are positioned in a headphone, such that surround sound effects are simulated by the left and right filtered signals provided to the headphone.

Another embodiment of the present disclosure relates to a positional audio engine for processing digital signal representative of a sound from a sound source. The audio engine includes a filter selection component configured to select one or more digital filters, with each of the one or more digital filters being formed from a particular range of a hearing response function, the selection based on spatial position of the sound source relative to a listener. The audio engine further includes a filter application component configured to apply the one or more digital filters to one or more digital signals so as to yield corresponding one or more filtered signals, with each of the one or more filtered signals having a simulated effect of the hearing response function applied to the sound from the sound source.

In one embodiment, the hearing response function includes a head-related transfer function (HRTF). In one embodiment, the particular range includes a particular range of frequency within the HRTF. In one embodiment, the particular range of frequency is substantially within or overlaps with a range of frequency that provides a location-discriminating sensitivity to an average human's hearing that is greater than an average sensitivity among an audible frequency. In one embodiment, the particular range of frequency includes or substantially overlaps with a peak structure in the HRTF. In one embodiment, the peak structure is substantially within or overlaps with a range of frequency between about 2.5 KHz and about 7.5 KHz. In one embodiment, the peak structure is substantially within or overlaps with a range of frequency between about 8.5 KHz and about 18 KHz.

In one embodiment, the one or more digital signals include left and right digital signals such that the one or more filtered signals include left and right filtered signals to be output to left and right speakers.

In one embodiment, the one or more digital filters include a plurality of digital filters. In one embodiment, each of the one or more digital signals is split into the same number of signals as the number of the plurality of digital filters such that the plurality of digital filters are applied in parallel to the plurality of split signals. In one embodiment, the each of one or more filtered signals is obtained by combining the plurality of split signals filtered by the plurality of digital filters. In one embodiment, the combining includes summing of the plurality of split signals.

In one embodiment, the plurality of digital filters include first and second digital filters. In one embodiment, each of the first and second digital filters includes a filter that yields a response that is substantially maximally flat in a passband portion and rolls off towards substantially zero in a stopband portion of the hearing response function. In one embodiment, each of the first and second digital filters includes a Butterworth filter. In one embodiment, the passband portion for one of the first and second digital filters is defined by a frequency range between about 2.5 KHz and about 7.5 KHz. In one embodiment, the passband portion for one of the first and second digital filters is defined by a frequency range between about 8.5 KHz and about 18 KHz.

In one embodiment, the selection of the one or more digital filters is based on a finite number of geometric positions about the listener. In one embodiment, the geometric positions include a plurality of hemi-planes, each hemi-plane defined by an edge along a direction between the ears of the listener and by an elevation angle $\phi$ relative to a horizontal plane defined by the ears and the front direction for the listener. In one embodiment, the plurality of hemi-planes are grouped into one or more front hemi-planes and one or more rear hemi-planes. In one embodiment, the front hemi-planes include hemi-planes at front of the listener and at elevation angles of approximately 0 and +/−45 degrees, and the rear hemi-planes include hemi-planes at rear of the listener and at elevation angles of approximately 0 and +/−45 degrees.

In one embodiment, the application of the one or more digital filters to the one or more digital signals simulates an effect of motion of the sound source about the listener.

In one embodiment, the application of the one or more digital filters to the one or more digital signals simulates an effect of placing the sound source at a selected location about the listener.

Yet another embodiment of the present disclosure relates to a system for processing digital audio signals. The system includes an interaural time difference (ITD) component configured to receive a mono input signal and generate left and right ITD-adjusted signals to simulate an arrival time difference of sound arriving at left and right ears of a listener from a sound source. The mono input signal includes information about spatial position of the sound source relative the listener. The system further includes a positional filter component configured to receive the left and right ITD-adjusted signals, apply one or more digital filters to each of the left and right ITD-adjusted signals to generate left and right filtered digital signals, with each of the one or more digital filters being based on a particular range of a hearing response function, such that the left and right filtered digital signals simulate the hearing response function. The system further includes an interaural intensity difference (IID) component configured to receive the left and right filtered digital signals and generate left and right IID-adjusted signal to simulate an intensity difference of the sound arriving at the left and right ears.

In one embodiment, the hearing response function includes a head-related transfer function (HRTF). In one embodiment, the particular range includes a particular range of frequency within the HRTF. In one embodiment, the particular range of frequency is substantially within or overlaps with a range of frequency that provides a location-discriminating sensitivity to an average human's hearing that is greater than an average sensitivity among an audible frequency. In one embodiment, the particular range of frequency includes or substantially overlaps with a peak structure in the HRTF. In one embodiment, the peak structure is substantially within or overlaps with a range of frequency between about 2.5 KHz and about 7.5 KHz. In one embodiment, the peak structure is substantially within or overlaps with a range of frequency between about 8.5 KHz and about 18 KHz.

In one embodiment, the ITD includes a quantity that is proportional to absolute value of $\sin\theta \cos\phi$, where $\theta$ represents an azimuthal angle of the sound source relative to the front of the listener, and $\phi$ represents an elevation angle of the sound source relative to a horizontal plane defined by the listener's ears and the front direction.

In one embodiment, the ITD determination is performed when the spatial position of the sound source changes. In one embodiment, the ITD component is further configured to perform a crossfade transition of the ITD between the previous value and the current value. In one embodiment, the crossfade transition includes changing the ITD from the previous value to the current value during a plurality of processing cycles.

In one embodiment, the ITD component is configured to determine whether the sound source is positioned at left or right relative to the listener. The ITD component is further configured to assign as a weaker signal the left or right filtered signal that is on the opposite side as the sound source. The ITD component is further configured to assign as a stronger signal the other of the left or right filtered signal. The ITD component is further configured to adjust the weaker signal by a first compensation. The ITD component is further configured to adjust the stronger signal by a second compensation.

In one embodiment, the first compensation includes a compensation value that is proportional to $\cos\theta$, where $\theta$ represents an azimuthal angle of the sound source relative to the front of the listener. In one embodiment, the second compensation includes a compensation value that is proportional to $\sin\theta$, where $\theta$ represents an azimuthal angle of the sound source relative to the front of the listener.

In one embodiment, the adjustment of the left and right filtered signals for IID is performed when new one or more digital filters are applied to the left and right filtered signals due to selected movements of the sound source. In one embodiment, the ITD component is further configured to perform a crossfade transition of the first and second compensation values between the previous values and the current values. In one embodiment, the crossfade transition includes changing the first and second compensation values during a plurality of processing cycles.

In one embodiment, the one or more digital filters include a plurality of digital filters. In one embodiment, each of the one or more digital signals is split into the same number of signals as the number of the plurality of digital filters such that the plurality of digital filters are applied in parallel to the plurality of split signals. In one embodiment, the each of the left and right filtered digital signals is obtained by combining the plurality of split signals filtered by the plurality of digital filters. In one embodiment, the combining includes summing of the plurality of split signals.

In one embodiment, the plurality of digital filters include first and second digital filters. In one embodiment, each of the first and second digital filters includes a filter that yields a response that is substantially maximally flat in a passband portion and rolls off towards substantially zero in a stopband portion of the hearing response function. In one embodiment, each of the first and second digital filters includes a Butterworth filter. In one embodiment, the passband portion for one of the first and second digital filters is defined by a frequency range between about 2.5 KHz and about 7.5 KHz. In one embodiment, the passband portion for one of the first and second digital filters is defined by a frequency range between about 8.5 KHz and about 18 KHz.

In one embodiment, the positional filter component is further configured to select the one or more digital filters based on a finite number of geometric positions about the listener. In one embodiment, the geometric positions include a plurality of hemi-planes, each hemi-plane defined by an edge along a direction between the ears of the listener and by an elevation angle $\phi$ relative to a horizontal plane defined by the ears and the front direction for the listener. In one embodiment, the plurality of hemi-planes are grouped into one or more front hemi-planes and one or more rear hemi-planes. In one embodiment, the front hemi-planes include hemi-planes at front of the listener and at elevation angles of approximately 0 and +/−45 degrees, and the rear hemi-planes include hemi-planes at rear of the listener and at elevation angles of approximately 0 and +/−45 degrees.

In one embodiment, the system further includes at least one of the following: a sample rate conversion component, a Doppler adjustment component configured to simulate sound source velocity, a distance adjustment component configured to account for distance of the sound source to the listener, an orientation adjustment component configured to account for orientation of the listener's head relative to the sound source, or a reverberation adjustment component to simulate reverberation effect.

Yet another embodiment of the present disclosure relates to a system for processing digital audio signals. The system includes a plurality of signal processing chains, with each chain including an interaural time difference (ITD) component configured to receive a mono input signal and generate left and right ITD-adjusted signals to simulate an arrival time difference of sound arriving at left and right ears of a listener from a sound source. The mono input signal includes information about spatial position of the sound source relative the listener. Each chain further includes a positional filter component configured to receive the left and right ITD-adjusted signals, apply one or more digital filters to each of the left and right ITD-adjusted signals to generate left and right filtered digital signals, with each of the one or more digital filters being based on a particular range of a hearing response function, such that the left and right filtered digital signals simulate the hearing response function. Each chain further includes an interaural intensity difference (IID) component configured to receive the left and right filtered digital signals and generate left and right IID-adjusted signal to simulate an intensity difference of the sound arriving at the left and right ears.

Yet another embodiment of the present disclosure relates to an apparatus having a means receiving one or more digital signals. The apparatus further includes a means for selecting one or more digital filters based on information about spatial position of a sound source. The apparatus further includes a means for applying the one or more filters to the one or more digital signals so as to yield corresponding one or more filtered signals that simulate an effect of a hearing response function.

Yet another embodiment of the present disclosure relates to an apparatus having a means for forming one or more electronic filters, and a means for applying the one or more electronic filters to a sound signal so as to simulate a three-dimensional sound effect.

BRIEF DESCRIPTION OF THE DRAWINGS

These and other aspects, advantages, and novel features of the present teachings will become apparent upon reading the following detailed description and upon reference to the accompanying drawings. In the drawings, similar elements have similar reference numerals.

DETAILED DESCRIPTION OF SOME EMBODIMENTS

The present disclosure generally relates to audio signal processing technology. In some embodiments, various features and techniques of the present disclosure can be implemented on audio or audio/visual devices. As described herein, various features of the present disclosure allow efficient processing of sound signals, so that in some applications, realistic positional sound imaging can be achieved even with limited signal processing resources. As such, in some embodiments, sound having realistic impact on the listener can be output by portable devices such as handheld devices where computing power may be limited. It will be understood that various features and concepts disclosed herein are not limited to implementations in portable devices, but can be implemented in any electronic devices that process sound signals.

Figure 1:
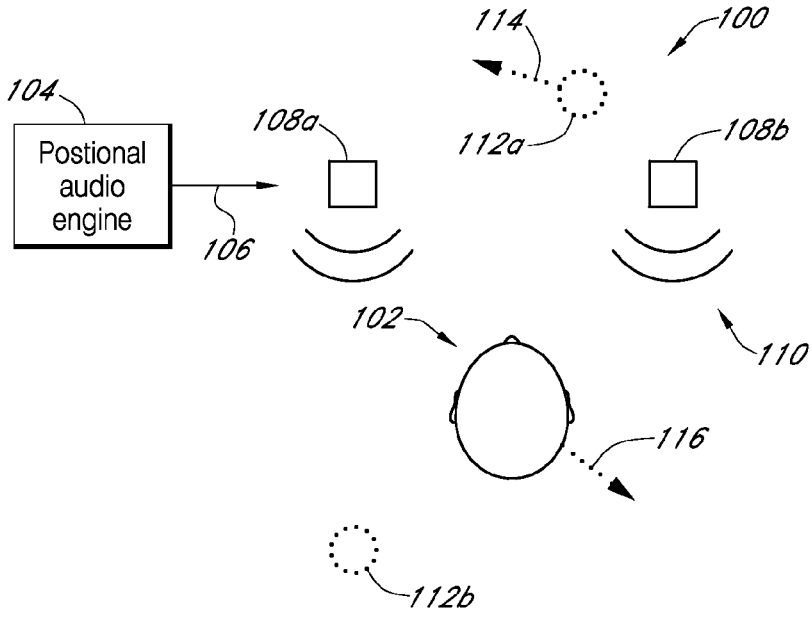
FIG. 1 shows an example listening situation where a positional audio engine can provide sound effect of moving sound source(s) to a listener.

FIG. 1 shows an example situation 100 where a listener 102 is shown to listen to sound 110 from speakers 108. The listener 102 is depicted as perceiving one or more sound sources 112 as being at certain locations relative to the listener 102. The example sound source 112*a* "appears" to be in front and right of the listener 102; and the example sound source 112*b* appears to be at rear and left of the listener. The sound source 112*a* is also depicted as being moving (indicated as arrow 114) relative to the listener 102.

As also shown in FIG. 1, some sounds can make it appear that the listener 102 is moving with respect to some sound source. Many other combinations of sound-source and listener orientation and motion can be effectuated. In some embodiments, such audio perception combined with corresponding visual perception (from a screen, for example) can provide an effective and powerful sensory effect to the listener.

In one embodiment, a positional audio engine 104 can generate and provide signal 106 to the speakers 108 to achieve such a listening effect. Various embodiments and features of the positional audio engine 104 are described below in greater detail.

Figure 2:
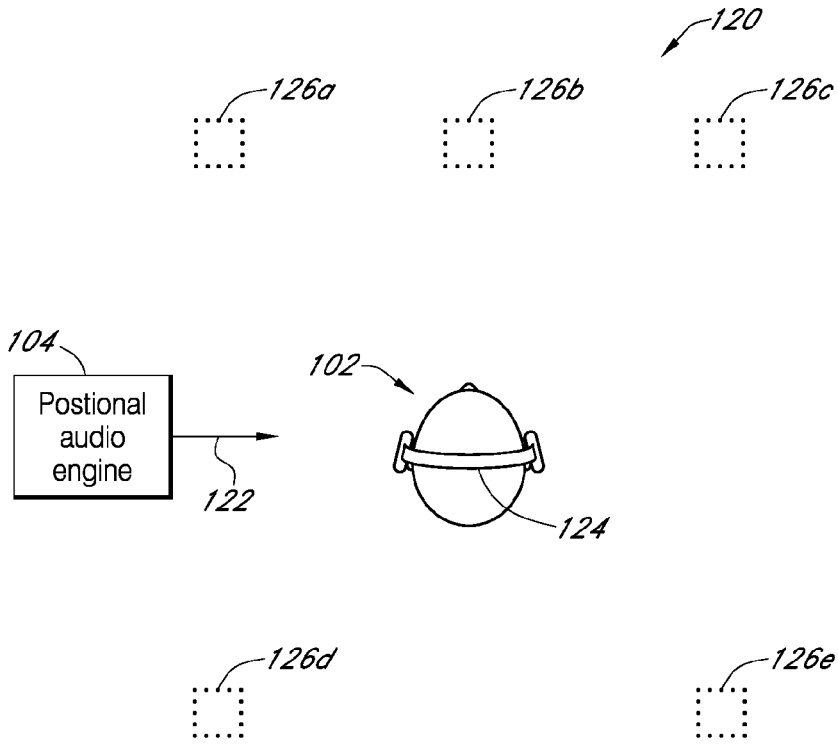
FIG. 2 shows another example listening situation where the positional audio engine can provide a surround sound effect to a listener using a headphone.

FIG. 2 shows another example situation 120 where the listener 102 is listening to sound from a two-speaker device such as a headphone 124. Again, the positional audio engine 104 is depicted as generating and providing signal 122 to the example headphone. In this example implementation, sounds perceived by the listener 102 make it appear that there are multiple sound sources at substantially fixed locations relative to the listener 102. For example, a surround sound effect can be created by making sound sources 126 (five in this example, but other numbers and configurations are possible also) appear to be positioned at certain locations.

In some embodiments, such audio perception combined with corresponding visual perception (from a screen, for example) can provide an effective and powerful sensory effect to the listener. Thus, for example, a surround-sound effect can be created for a listener listening to a handheld device through a headphone. Various embodiments and features of the positional audio engine 104 are described below in greater detail.

Figure 3:
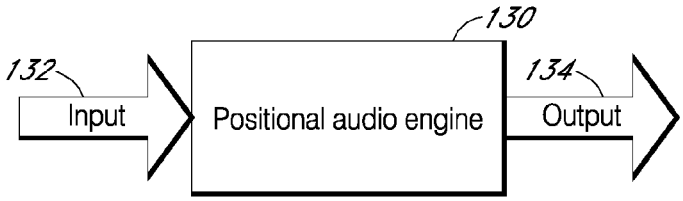
FIG. 3 shows a block diagram of an overall functionality of the positional audio engine.

FIG. 3 shows a block diagram of a positional audio engine 130 that receives an input signal 132 and generates an output signal 134. Such signal processing with features as described herein can be implemented in numerous ways. In a non-limiting example, some or all of the functionalities of the positional audio engine 130 can be implemented as an application programming interface (API) between an operating system and a multimedia application in an electronic device. In another non-limiting example, some or all of the functionalities of the engine 130 can be incorporated into the source data (for example, in the data file or streaming data).

Other configurations are possible. For example, various concepts and features of the present disclosure can be implemented for processing of signals in analog systems. In such systems, analog equivalents of positional filters can be configured based on location-critical information in a manner similar to the various techniques described herein. Thus, it will be understood that various concepts and features of the present disclosure are not limited to digital systems.

Figure 4:
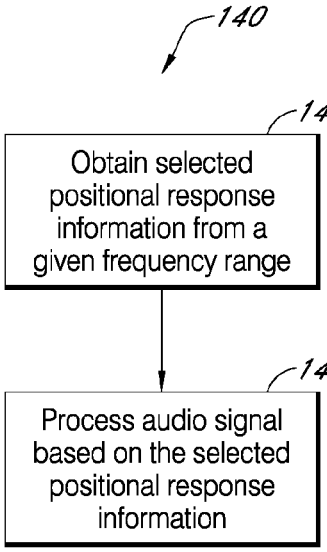
FIG. 4 shows one embodiment of a process that can be performed by the positional audio engine of FIG. 3.

FIG. 4 shows one embodiment of a process 140 that can be performed by the positional audio engine 130. In a process block 142, selected positional response information is obtained among a given frequency range. In one embodiment, the given range can be an audible frequency range (for example, from about 20 Hz to about 20 KHz). In a process block 144, audio signal is processed based on the selected positional response information.

Figure 5:
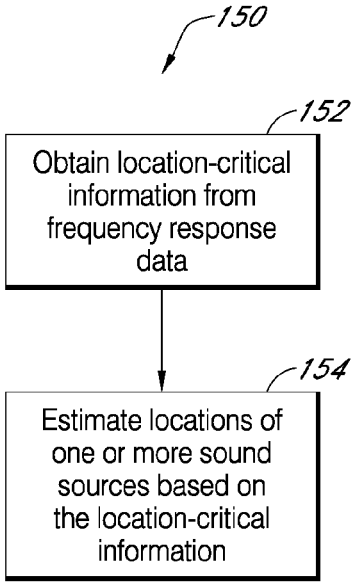
FIG. 5 shows one embodiment of a process that can be a more specific example of the process of FIG. 4.

FIG. 5 shows one embodiment of a process 150 where the selected positional response information of the process 140 (FIG. 4) can be a location-critical or location-relevant information. In a process block 152, location-critical information is obtained from frequency response data. In a process block 154, locations or one or more sound sources are determined based on the location-critical information.

Figure 6:
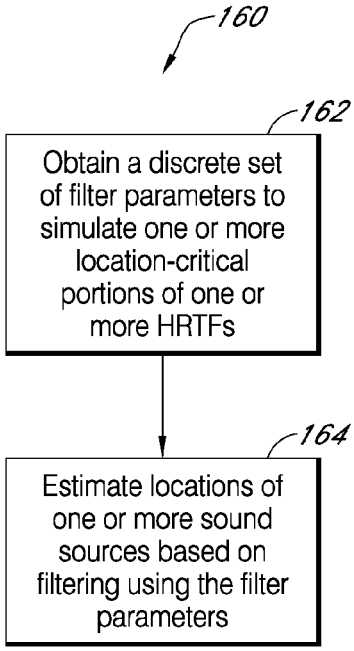
FIG. 6 shows one embodiment of a process that can be a more specific example of the process of FIG. 5.

FIG. 6 shows one embodiment of a process 160 where a more specific implementation of the process 150 (FIG. 5) can be performed. In a process block 162, a discrete set of filter parameters are obtained, where the filter parameters can simulate one or more location-critical portions of one or more HRTFs (Head-Related Transfer Functions). In one embodiment, the filter parameters can be filter coefficients for digital signal filtering. In a process block 164, locations of one or more sound sources are determined based on filtering using the filter parameters.

For the purpose of description, "location-critical" means a portion of human hearing response spectrum (for example, a frequency response spectrum) where sound source location discrimination is found to be particularly acute. HRTF is an example of a human hearing response spectrum. Studies (for example, "A comparison of spectral correlation and local feature-matching models of pinna cue processing" by E. A. Macperson, *Journal of the Acoustical Society of America,* 101, 3105, 1997) have shown that human listeners generally do not process entire HRTF information to distinguish where sound is coming from. Instead, they appear to focus on certain features in HRTFs. For example, local feature matches and gradient correlations in frequencies over 4 KHz appear to be particularly important for sound direction discrimination, while other portions of HRTFs are generally ignored.

Figure 7A:
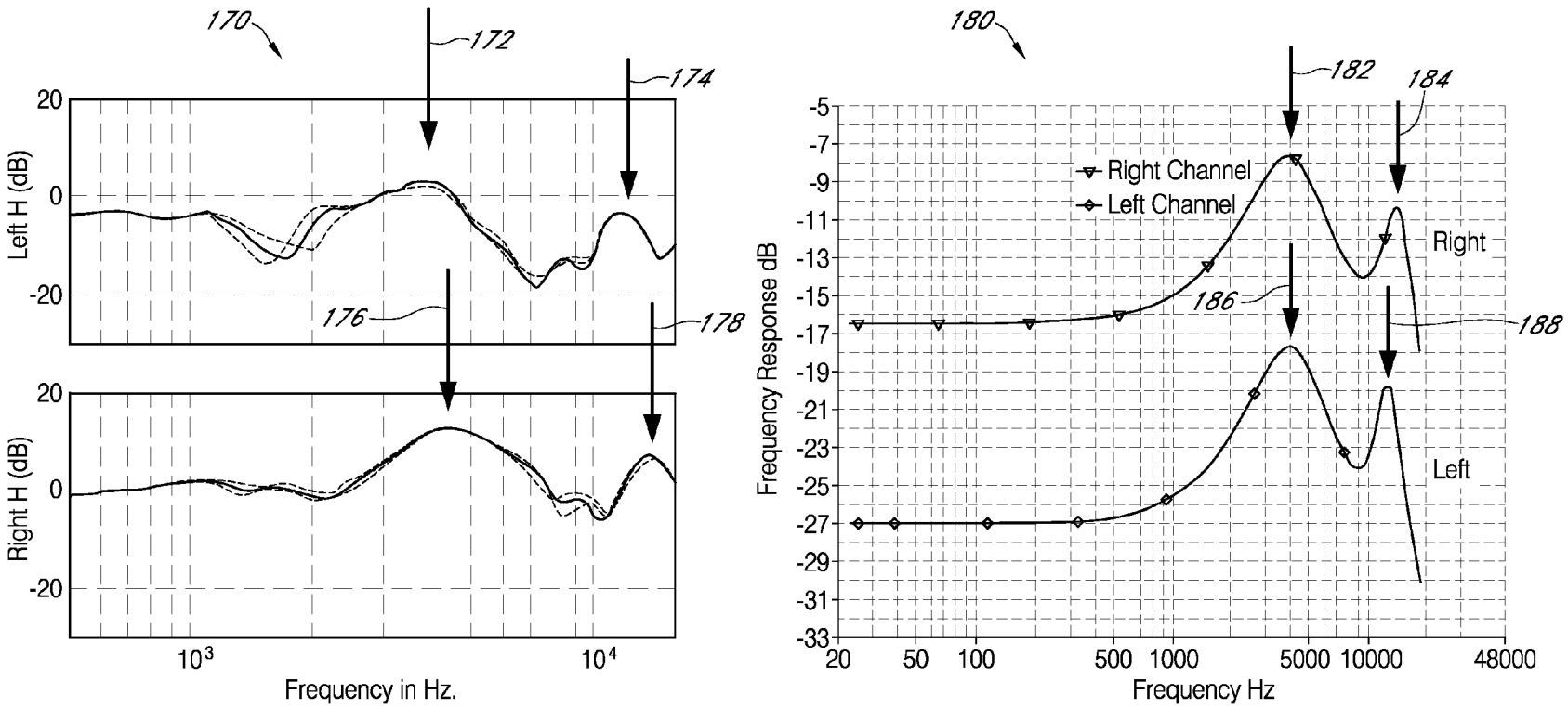
FIG. 7A shows, by way of example, how one or more location-critical information from response curves can be converted to relatively simple filter responses.

FIG. 7A shows example HRTFs 170 corresponding to left and right ears' hearing responses to an example sound source positioned in front at about 45 degrees to the right (at about the ear level). In one embodiment, two peak structures indicated by arrows 172 and 174, and related structures (such as the valley between the peaks 172 and 174) can be considered to be location-critical for the left ear hearing of the example sound source orientation. Similarly, two peak structures indicated by arrows 176 and 178, and related structures (such as the valley between the peaks 176 and 178) can be considered to be location-critical for the right ear hearing of the example sound source orientation.

Figure 7B:
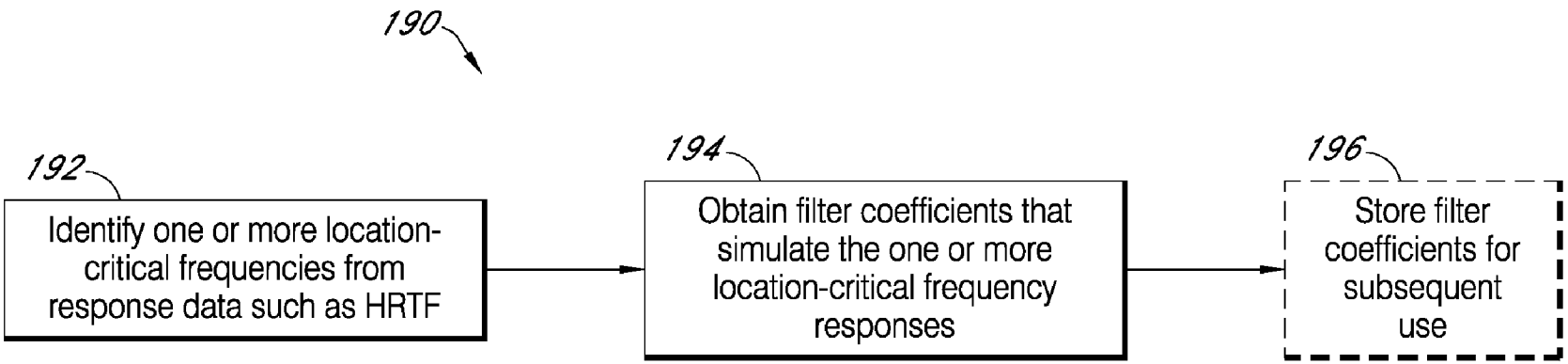
FIG. 7B shows one embodiment of a process that can provide the example conversion of FIG. 7A.

FIG. 7B shows one embodiment of process 190 that, in a process block 192, can identify one or more location-critical frequencies (or frequency ranges) from response data such as the example HRTFs 170 of FIG. 7A. In the example HRTFs 170, two example frequencies are indicated by the arrows 172, 174, 176, and 178. In a process block 194, filter coefficients that simulate the one or more such location-critical frequency responses can be obtained. As described herein, and as shown in a process block 196, such filter coefficients can be used subsequently to simulate the response of the example sound source orientation that generated the HRTFs 170.

Simulated filter responses 180 corresponding to the HRTFs 170 can result from the filter coefficients determined in the process block 194. As shown, peaks 186, 188, 182, and 184 (and the corresponding valleys) are replicated so as to provide location-critical responses for location discrimination of the sound source. Other portions of the HRTFs 170 are shown to be generally ignored, thereby represented as substantially flat responses at lower frequencies.

Because only certain portion(s) and/or structure(s) are selected (in this example, the two peaks and related valley), formation of filter responses (for example, determination of the filter coefficients that yields the example simulated responses 180) can be simplified greatly. Moreover, such filter coefficients can be stored and used subsequently in a greatly simplified manner, thereby substantially reducing the computing power required to effectuate realistic location-discriminating sound output to a listener. Specific examples of filter coefficient determination and subsequent use are described below in greater detail.

In the description herein, filter coefficient determination and subsequent use are described in the context of the example two-peak selection. It will be understood, however, that in some embodiments, other portion(s) and/or feature(s) of HRTFs can be identified and simulated. So for example, if a given HRTF has three peaks that can be location-critical, those three peaks can be identified and simulated. Accordingly, three filters can represent those three peaks instead of two filters for the two peaks.

In one embodiment, the selected features and/or ranges of the HRTFs (or other frequency response curves) can be simulated by obtaining filter coefficients that generate an approximated response of the desired features and/or ranges. Such filter coefficients can be obtained using any number of known techniques.

In one embodiment, simplification that can be provided by the selected features (for example, peaks) allows use of simplified filtering techniques. In one embodiment, fast and simple filtering, such as infinite impulse response (IIR), can be utilized to simulate the response of a limited number of selected location-critical features.

By way of example, the two example peaks (172 and 174 for the left hearing, and 176 and 178 for the right hearing) of the example HRTFs 170 can be simulated using a known Butterworth filtering technique. Coefficients for such known filters can be obtained using any known techniques, including, for example, signal processing applications such as MATLAB. Table 1 shows examples of MATLAB function calls that can return simulated responses of the example HRTFs 170.

TABLE 1

| Peak | Gain | MATLAB filter function call Butter(Order, Normalized range, Filter type) |
|---|---|---|
| Peak 172 (Left) | 2 dB | Order = 1<br>Range = [2700/(SamplingRate/2), 6000/(SamplingRate/2)]<br>Filter type = 'bandpass' |
| Peak 174 (Left) | 2 dB | Order = 1<br>Range = [11000/(SamplingRate/2), 14000/(SamplingRate/2)]<br>Filter type = 'bandpass' |
| Peak 176 (Right) | 3 dB | Order = 1<br>Range = [2600/(SamplingRate/2), 6000/(SamplingRate/2)]<br>Filter type = 'bandpass' |
| Peak 178 (Right) | 11 dB | Order = 1<br>Range = [12000/(SamplingRate/2), 16000/(SamplingRate/2)]<br>Filter type = 'bandpass' |

In one embodiment, the foregoing example IIR filter responses to the selected peaks of the example HRTFs 170 can yield the simulated responses 180. The corresponding filter coefficients can be stored for subsequent use, as indicated in the process block 196 of the process 190.

As previously stated, the example HRTFs 170 and simulated responses 180 correspond to a sound source located at front at about 45 degrees to the right (at about the ear level). Response(s) to other source location(s) can be obtained in a similar manner to provide a two or three-dimensional response coverage about the listener. Specific filtering examples for other sound source locations are described below in greater detail.

Figure 8:
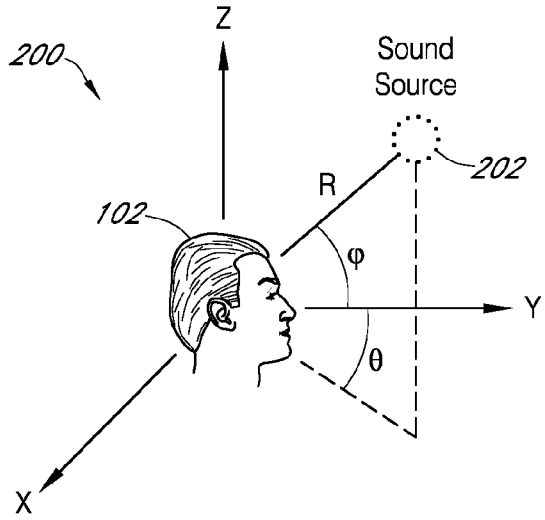
FIG. 8 shows an example spatial geometry definition for the purpose of description.

FIG. 8 shows an example spatial coordinate definition 200 for the purpose of description herein. The listener 102 is assumed to be positioned at the origin. The Y-axis is considered to be the front to which the listener 102 faces. Thus, the X-Y plane represents the horizontal plane with respect to the listener 102. A sound source 202 is shown to be located at a distance "R" from the origin. The angle $\phi$ represents the elevation angle from the horizontal plane, and the angle $\theta$ represents the azimuthal angle from the Y-axis. Thus, for example, a sound source located directly behind the listener's head would have $\theta$=180 degrees, and $\phi$=0 degree.

Figure 9:
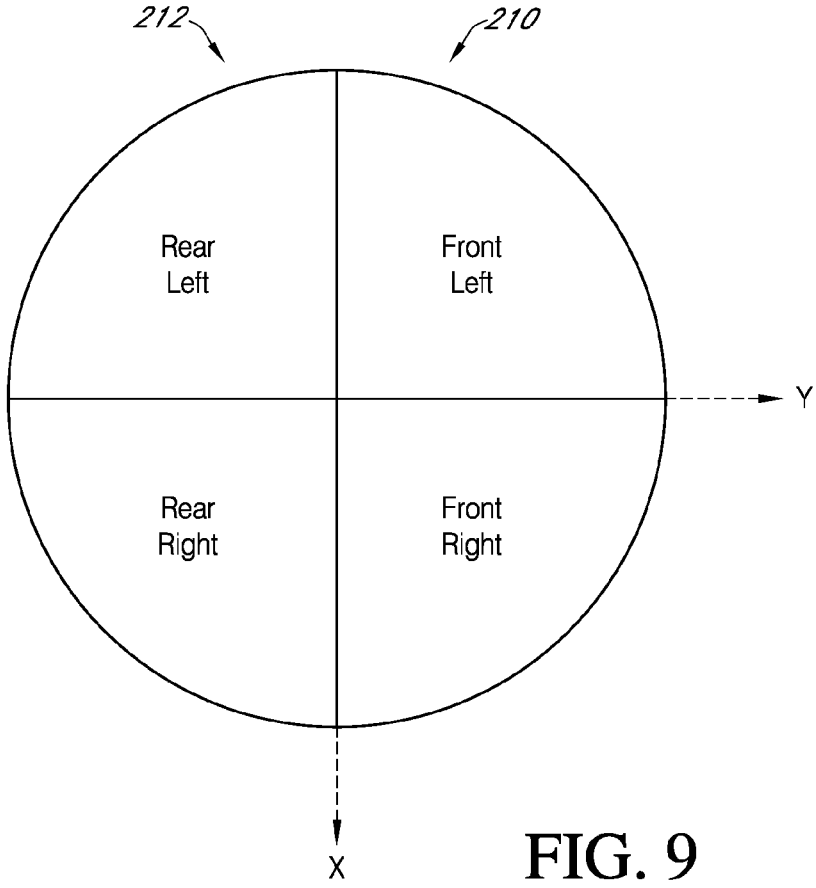
FIG. 9 shows an example spatial configuration where space about a listener can be divided into four quadrants.

In one embodiment, as shown in FIG. 9, space about the listener (at the origin) can be divided into front and rear, as well as left and right. In one embodiment, a front hemi-plane 210 and a rear hemi-plane 212 can be defined, such that together they define a plane having an elevation angle $\phi$ and intersects the X-Y plane at the X-axis. Thus, for example, the example sound source at $\theta$=45 and $\phi$=0, and corresponding to the example HRTFs 170 of FIG. 7A, is in the Front-Right (FR) section and in the front hemi-plane at $\phi$=0.

In one embodiment, as described below in greater detail, various hemi-planes can be above and/or below the horizontal to account for sound sources above and/or below the ear level. For a given hemi-plane, a response obtained for one side (e.g., right side) can be used to estimate the response at the mirror image location (about the Y-Z plane) on the other side (e.g., left side) by way of symmetry of the listener's head. In one embodiment, because such symmetry does not exist for front and rear, separate responses can be obtained for the front and rear (and thus the front and rear hemi-planes).

Figure 10:
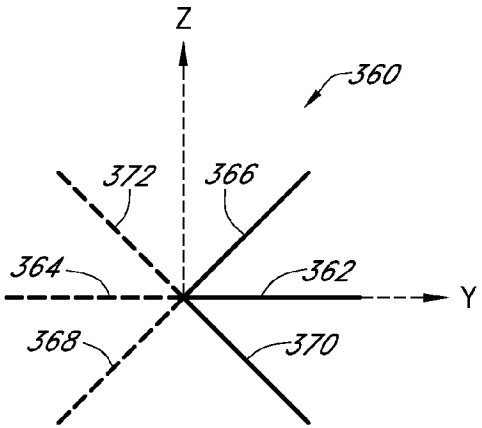
FIG. 10 shows an example spatial configuration where sound sources in the spatial configuration of FIG. 9 can be approximated as being positioned on a plurality of discrete hemi-planes about the X-axis, thereby simplifying the positional filtering process.

FIG. 10 shows that in one embodiment, the space around the listener (at the origin) can be divided into a plurality of front and rear hemi-planes. In one embodiment, a front hemi-plane 362 can be at a horizontal orientation (ϕ=0), and the corresponding rear hemi-plane 364 would also be substantially horizontal. A front hemi-plane 366 can be at a front-elevated orientation of about 45 degrees (ϕ=45°), and the corresponding rear hemi-plane 368 would be at about 45 degrees below the rear hemi-plane 364. A front hemi-plane 370 can be at an orientation of about −45 degrees (ϕ=−45°), and the corresponding rear hemi-plane 372 would be at about 45 degrees above the rear hemi-plane 364.

In one embodiment, sound sources about the listener can be approximated as being on one of the foregoing hemi-planes. Each hemi-plane can have a set of filter coefficients that simulate response of sound sources on that hemi-plane. Thus, the example simulated response described above in reference to FIG. 7A can provide a set of filter coefficients for the front horizontal hemi-plane 362. Simulated responses to sound sources located anywhere on the front horizontal hemi-plane 362 can be approximated by adjusting relative gains of the left and right responses to account for left and right displacements from the front direction (Y-axis). Moreover, other parameters such as sound source distance and/or velocity can also be approximated in a manner described below.

Figure 11A:
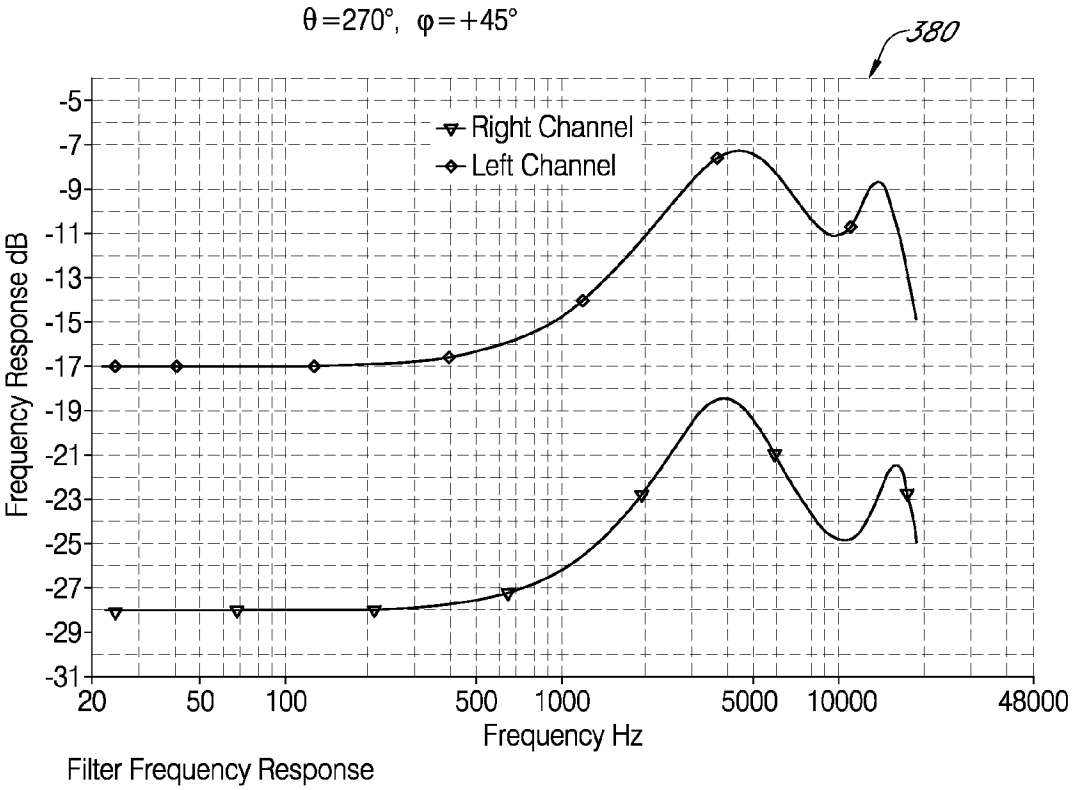
FIGS. 11A-11C show example response curves such as HRTFs that can be obtained at various example locations on some of the hemi-planes of FIG. 10, such that position-critical simulated filter responses can be obtained for various hemi-planes.
Figure 11B:
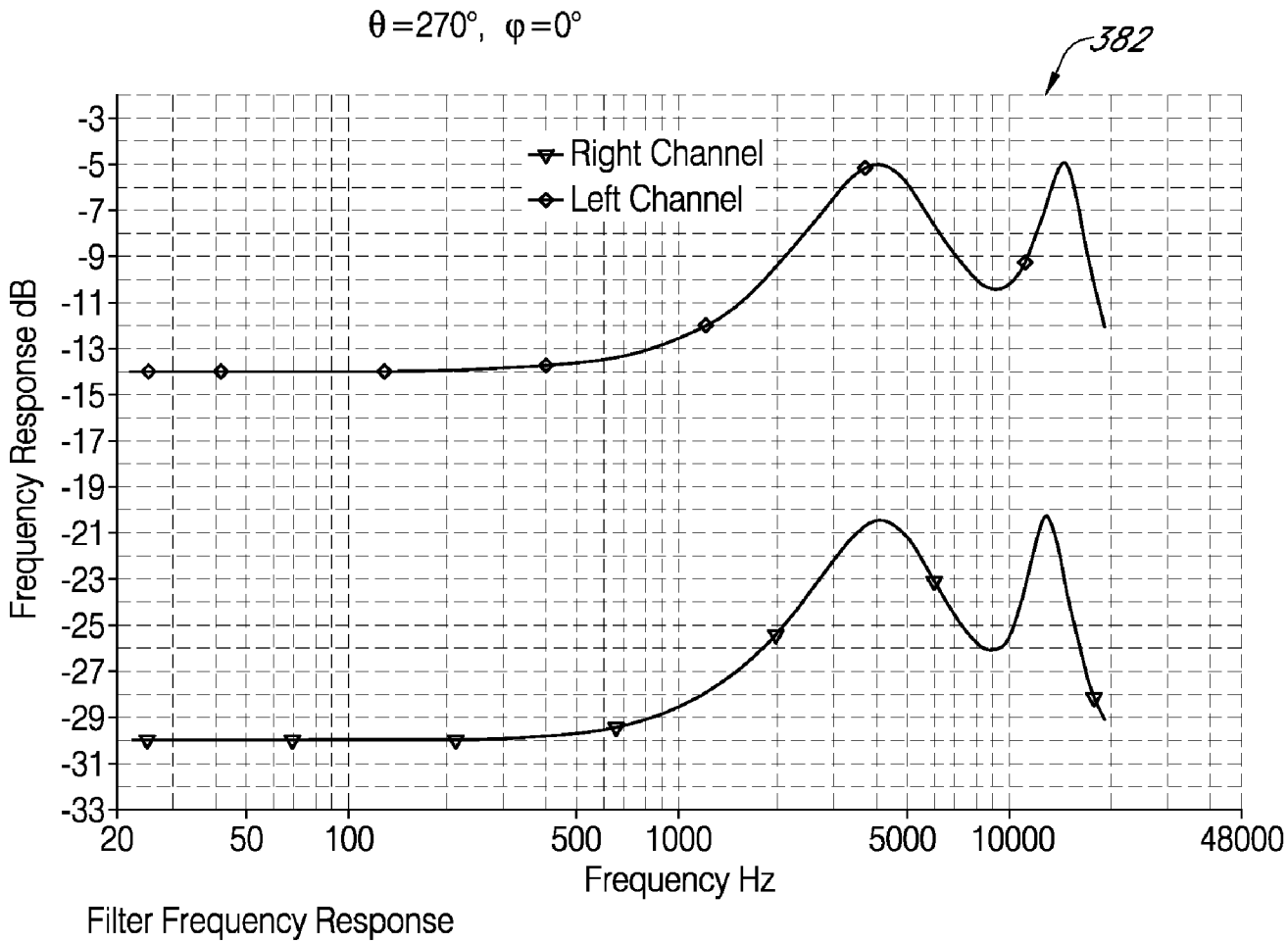
Figure 11C:
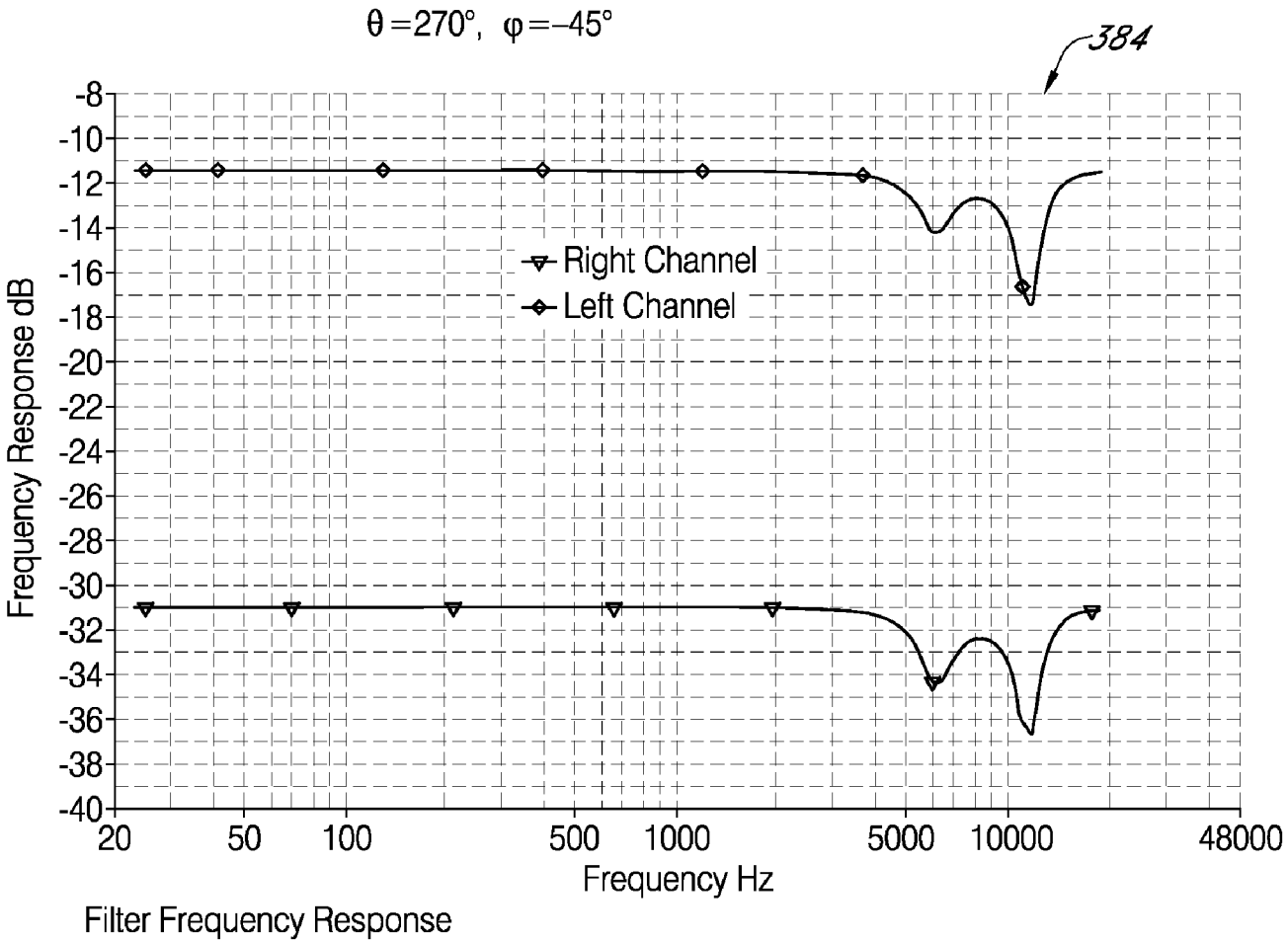

FIGS. 11A-11C show some examples of simulated responses to various corresponding HRTFs (not shown) that can be obtained in a manner similar to that described above. FIG. 11A shows an example simulated response 380 obtained from location-critical portions of HRTFs corresponding to θ=270° and ϕ=+45° (directly left for the front elevated hemi-plane 366). FIG. 1B shows an example simulated response 382 obtained from location-critical portions of HRTFs corresponding to θ=270° and ϕ=0° (directly left for the horizontal hemi-plane 362). FIG. 11C shows an example simulated response 384 obtained from location-critical portions of HRTFs corresponding to θ=270° and ϕ=−45° (directly left for the front lowered hemi-plane 370). Similar simulated responses can be obtained for the rear hemi-planes 372, 364, and 368. Moreover, such simulated responses can be obtained at various values of θ.

Note that in the example simulated response 384, a band-stop Butterworth filtering can be used to obtain a desired approximation of the identified features. Thus, it should be understood that various types of filtering techniques can be used to obtain desired results. Moreover, filters other than Butterworth filters can be used to achieve similar results. Moreover, although IIR filter are used to provide fast and simple filtering, at least some of the techniques of the present disclosure can also be implemented using other filters (such as finite impulse response (FIR) filters).

For the foregoing example hemi-plane configuration (ϕ=+45°, 0°, −45°), Table 2 lists filtering parameters that can be input to obtain filter coefficients for the six hemi-planes (366, 362, 370, 372, 364, and 368). For the example parameters in Table 2 (as in Table 1), the example Butterworth filter function call can be made in MATLAB as:

"butter(Order, [$f_{Low}$/(SamplingRate/2),$f_{High}$/(SamplingRate/2), Type)"

where Order represents the highest order of filter terms, $f_{Low}$ and $f_{High}$ represent the boundary values of the selected frequency range, and SamplingRate represents the sampling rate, and Type represents the filter type, for each given filter. Other values and/or types for filter parameters are also possible.

TABLE 2

| Hemi-plane | Filter | Gain (dB) | Order | Frequency Range ($f_{Low}$, $f_{High}$) (KHz) | Type |
|---|---|---|---|---|---|
| Front, ϕ = +0° | Left #1 | 2 | 1 | 2.7, 6.0 | bandpass |
| Front, ϕ = +0° | Left #2 | 2 | 1 | 11, 14 | bandpass |
| Front, ϕ = +0° | Right #1 | 3 | 1 | 2.6, 6.0 | bandpass |
| Front, ϕ = +0° | Right #2 | 11 | 1 | 12, 16 | bandpass |
| Front, ϕ = +45° | Left #1 | −4 | 1 | 2.5, 6.0 | bandpass |
| Front, ϕ = +45° | Left #2 | −1 | 1 | 13, 18 | bandpass |
| Front, ϕ = +45° | Right #1 | 9 | 1 | 2.5, 7.5 | bandpass |
| Front, ϕ = +45° | Right #2 | 6 | 1 | 11, 16 | bandpass |
| Front, ϕ = −45° | Left #1 | −15 | 1 | 5.0, 7.0 | bandstop |
| Front, ϕ = −45° | Left #2 | −11 | 1 | 10, 13 | bandstop |
| Front, ϕ = −45° | Right #1 | −3 | 1 | 5.0, 7.0 | bandstop |
| Front, ϕ = −45° | Right #2 | 3 | 1 | 10, 13 | bandstop |
| Rear, ϕ = +0° | Left #1 | 6 | 1 | 3.5, 5.2 | bandpass |
| Rear, ϕ = +0° | Left #2 | 1 | 1 | 9.5, 12 | bandpass |
| Rear, ϕ = +0° | Right #1 | 13 | 1 | 3.3, 5.1 | bandpass |
| Rear, ϕ = +0° | Right #2 | 6 | 1 | 10, 14 | bandpass |
| Rear, ϕ = +45° | Left #1 | 6 | 1 | 2.5, 7.0 | bandpass |
| Rear, ϕ = +45° | Left #2 | 1 | 1 | 11, 16 | bandpass |
| Rear, ϕ = +45° | Right #1 | 13 | 1 | 2.5, 7.0 | bandpass |
| Rear, ϕ = +45° | Right #2 | 6 | 1 | 12, 15 | bandpass |
| Rear, ϕ = −45° | Left #1 | 6 | 1 | 5.0, 7.0 | bandstop |
| Rear, ϕ = −45° | Left #2 | 1 | 1 | 10, 12 | bandstop |
| Rear, ϕ = −45° | Right #1 | 13 | 1 | 5.0, 7.0 | bandstop |
| Rear, ϕ = −45° | Right #2 | 6 | 1 | 8.5, 11 | bandstop |

In one embodiment, as seen in Table 2, each hemi-plane can have four sets of filter coefficients: two filters for the two example location-critical peaks, for each of left and right. Thus, with six hemi-planes, there can be 24 filters.

In one embodiment, same filter coefficients can be used to simulate responses to sound from sources anywhere on a given hemi-plane. As described below in greater detail, effects due to left-right displacement, distance, and/or velocity of the source can be accounted for and adjusted. If a source moves from one hemi-plane to another hemi-plane, transition of filter coefficients can be implemented, in a manner described below, so as to provide a smooth transition in the perceived sound.

In one embodiment, if a given sound source is located at a location somewhere between two hemi-planes (for example, the source is at front, ϕ=+30°), then the source can be considered to be at the "nearest" plane (for example, the nearest hemi-plane would be the front, ϕ=+45°). As one can see, it may be desirable in certain situations to provide more or less hemi-planes in space about the listener, so as to provide less or more "granularity" in distribution of hemi-planes.

Moreover, the three-dimensional space does not necessarily need to be divided into hemi-planes about the X-axis. The space could be divided into any one, two, or three dimensional geometries relative to a listener. In one embodiment, as done in the hemi-planes about the X-axis, symmetries such as left and right hearings can be utilized to reduce the number of sets of filter coefficients.

It will be understood that the six hemi-plane configuration (ϕ=+45°, 0°, −45°) described above is an example of how selected location-critical response information can be provided for a limited number of orientations relative to a listener. By doing so, substantially realistic three-dimensional sound effects can be reproduced using relatively little computing power and/or resources. Even if the number of hemi-planes are increased for finer granularity—say to ten (front and rear at ϕ=+60°, +30°, 0°, −30°, −60°)—the number of sets of filter coefficients can be maintained at a manageable level.

Figure 12:
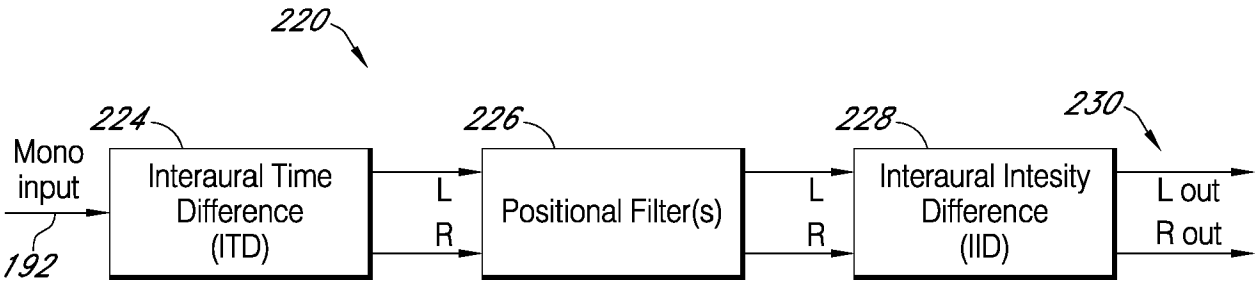
FIG. 12 shows that in one embodiment, positional filters can provide position-critical simulated filter responses, and can operate with an interaural time difference (ITD) interaural intensity difference (IID) functionalities.

FIG. 12 shows one embodiment of a functional block diagram 220 where positional filtering 226 can provide functionalities of the positional audio engine by simulation of the location-critical information as described above. In one embodiment, a mono input signal 222 having information about location of a sound source can be input to a component 224 that determines an interaural time delay (or difference) ("ITD"). ITD can provide information about the difference in arrival times to the two ears based on the source's location information. An example of ITD functionality is described below in greater detail.

In one embodiment, the ITD component 224 can output left and right signals that take into account the arrival difference, and such output signals can be provided to the positional-filters component 226. An example operation of the positional-filters component 226 is described below in greater detail.

In one embodiment, the positional-filters component 226 can output left and right signals that have been adjusted for the location-critical responses. Such output signals can be provided into a component 228 that determines an interaural intensity difference ("IID"). IID can provide adjustments of the positional-filters outputs to adjust for position-dependence in the intensities of the left and right signals. An example of IID compensation is described below in greater detail. Left and right signals 230 can be output by the IID component 228 to speakers to provide positional effect of the sound source.

Figure 13:
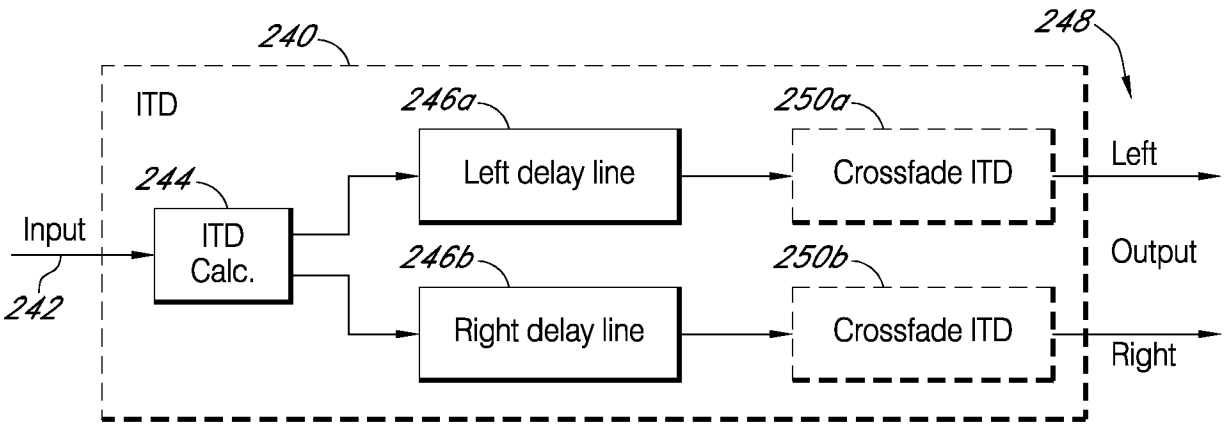
FIG. 13 shows one embodiment of the ITD component of FIG. 12.

FIG. 13 shows a block diagram of one embodiment of an ITD 240 that can be implemented as the ITD component 224 of FIG. 12. As shown, an input signal 242 can include information about the location of a sound source at a given sampling time. Such location can include the values of θ and ϕ of the sound source.

The input signal 242 is shown to be provided to an ITD calculation component 244 that calculates interaural time delay needed to simulate different arrival times (if the source is located to one side) at the left and right ears. In one embodiment, the ITD can be calculated as $$ITD=|(Maximum_ITD_Samples_per_Sampling_Rate-1)\sin\theta\cos\phi|. \quad (1)$$

Thus, as expected, ITD=0 when a source is either directly in front (θ=0°) or directly at rear (θ=180°); and ITD has a maximum value (for a given value of ϕ) when the source is either directly to the left (θ=270°) or to the right (θ=90°). Similarly, ITD has a maximum value (for a given value of θ) when the source is at the horizontal plane (ϕ=0°), and zero when the source is either at top (ϕ=90°) or bottom (ϕ=−90°) locations.

The ITD determined in the foregoing manner can be introduced to the input signal 242 so as to yield left and right signals that are ITD adjusted. For example, if the source location is on the right side, the right signal can have the ITD subtracted from the timing of the sound in the input signal. Similarly, the left signal can have the ITD added to the timing of the sound in the input signal. Such timing adjustments to yield left and right signals can be achieved in a known manner, and are depicted as left and right delay lines 246*a* and 246*b*.

If a sound source is substantially stationary relative to the listener, the same ITD can provide the arrival-time based three-dimensional sound effect. If a sound source moves, however, the ITD may also change. If a new value of ITD is incorporated into the delay lines, there may be a sudden change from the previous ITD based delays, possibly resulting in a detectable shift in the perception of ITDs.

In one embodiment, as shown in FIG. 13, the ITD component 240 can further include crossfade components 250*a* and 250*b* that provide smoother transitions to new delay times for the left and right delay lines 246*a* and 246*b*. An example of ITD crossfade operation is described below in greater detail.

As shown in FIG. 13, left and right delay adjusted signals 248 are shown to be output by the ITD component 240. As described above, the delay adjusted signals 248 may or may not be crossfaded. For example, if the source is stationary, there may not be a need to crossfade, since the ITD remains substantially the same. If the source moves, crossfading may be desired to reduce or substantially eliminate sudden shifts in ITDs due to changes in source locations.

Figure 14:
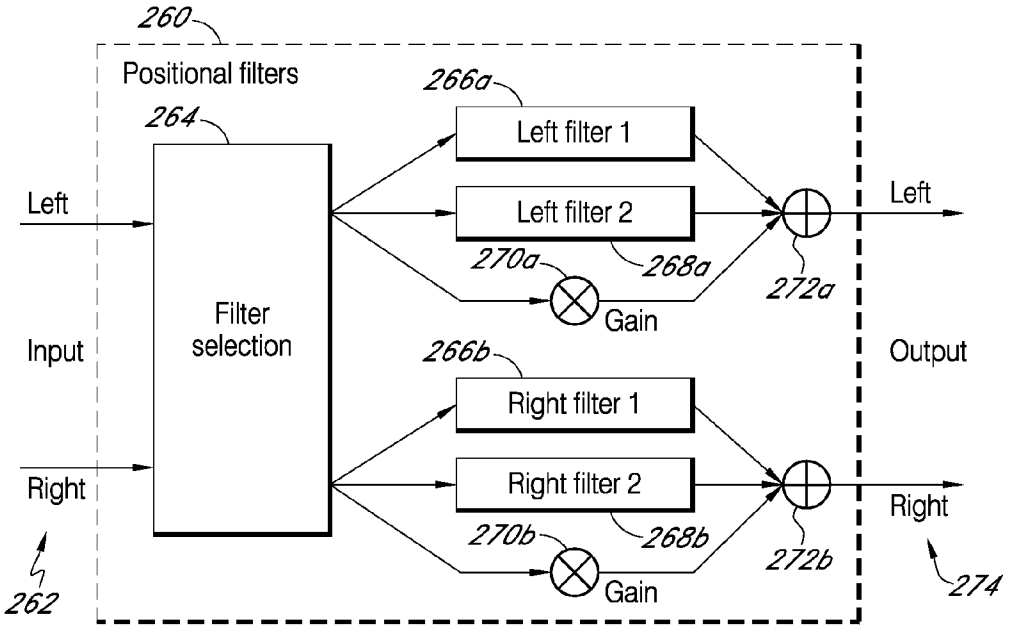
FIG. 14 shows one embodiment of the positional filters component of FIG. 12.

FIG. 14 shows a block diagram of one embodiment of a positional-filters component 260 that can be implemented as the component 226 of FIG. 12. As shown, left and right signals 262 are shown to be input to the positional-filters component 260. In one embodiment, the input signals 262 can be provided by the ITD component 240 of FIG. 13. However, it will be understood that various features and concepts related to filter preparation (e.g., filter coefficient determination based on location-critical response) and/or filter use do not necessarily depend on having input signals provided by the ITD component 240. For example, an input signal from a source data may already have left/right differentiated information and/or ITD-differentiated information. In such a situation, the positional-filters component 260 can operate as a substantially stand-alone component to provide a functionality that includes providing frequency response of sound based on selected location-critical information.

As shown in FIG. 14, the left and right input signals 262 can be provided to a filter selection component 264. In one embodiment, filter selection can be based on the values of θ and ϕ associated with the sound source. For the six-hemi-plane example described herein, θ and ϕ can uniquely associate the sound source location to one of the hemi-planes. As described above, if a sound source is not on one of the hemi-planes, that source can be associated with the "nearest" hemi-plane.

For example, suppose that a sound source is located at θ=10° and ϕ=+10°. In such a situation, the front horizontal hemi-plane (362 in FIG. 10) can be selected, since the location is in front and the horizontal orientation is the nearest to the 10-degree elevation. The front horizontal hemi-plane 362 can have a set of filter coefficients as determined in the example manner shown in Table 2. Thus, four example filters (2 left and 2 right) corresponding to the "Front, ϕ=+0°" hemi-plane can be selected for this example source location.

As shown in FIG. 14, left filters 266*a* and 268*a* (identified by the selection component 264) can be applied to the left signal, and right filters 266*b* and 268*b* (also identified by the selection component 264) can be applied to the right signal. In one embodiment, each of the filters 266*a*, 268*a*, 266*b*, and 268*b* operate on digital signals in a known manner based on their respective filter coefficients.

As described herein, the two left filters and two right filters are in the context of the two example location-critical peaks. It will be understood that other numbers of filters are possible. For example, if there are three location-critical features and/or ranges in the frequency responses, there may be three filters for each of the left and right sides.

As shown in FIG. 14, a left gain component 270*a* can adjust the gain of the left signal, and a right gain component 270*b* can adjust the gain of the right signal. In one embodiment, the following gains corresponding to the parameters of Table 12 can be applied to the left and right signals:

TABLE 3

| | 0 deg. Elevation | 45 deg. Elevation | −45 deg. Elevation |
|---|---|---|---|
| Left Gain | −4 dB | −4 dB | −20 dB |
| Right Gain | 2 dB | −1 dB | −5 dB |

In one embodiment, the example gain values listed in Table 3 can be assigned to substantially maintain a correct level difference between left and right signals at the three example elevations. Thus, these example gains can be used to provide correct levels in left and right processes, each of which, in this example, includes a 3-way summation of filter outputs (from first and second filters 266 and 268) and a scaled input (from gain component 270).

In one embodiment, as shown in FIG. 14, the filters and gain adjusted left and right signals can be summed by respective summers 272*a* and 272*b* so as to yield left and right output signals 274.

Figure 15:
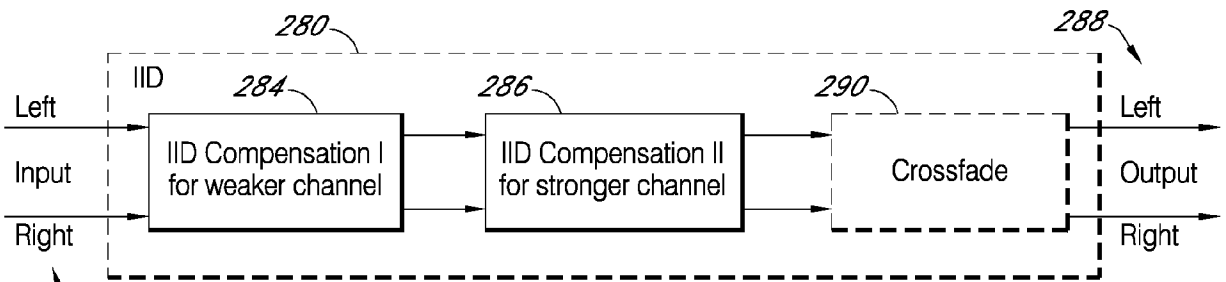
FIG. 15 shows one embodiment of the IID component of FIG. 12.

FIG. 15 shows a block diagram of one embodiment of an IID (interaural intensity difference) adjustment component 280 that can be implemented as the component 228 of FIG. 12. As shown, left and right signals 282 are shown to be input to the IID component 280. In one embodiment, the input signals 282 can be provided by the positional filters component 260 of FIG. 14.

In one embodiment, the IID component 280 can adjust the intensity of the weaker channel signal in a first compensation component 284, and also adjust the intensity of the stronger channel signal in a second compensation component 286. For example, suppose that a sound source is located at $\theta=10°$ (that is, to the right side by 10 degrees). In such a situation, the right channel can be considered to be the stronger channel, and the left channel the weaker channel. Thus, the first compensation 284 can be applied to the left signal, and the second compensation 286 to the right signal.

In one embodiment, the level of the weaker channel signal can be adjusted by an amount given as $$\text{Gain}=|\cos\theta(\text{Fixed_Filter_Level_Difference_per_Elevation}-1.0)|+1.0. \quad (2)$$

Thus, if $\theta=0$ degree (directly in front), the gain of the weaker channel is adjusted by the original filter level difference. If $\theta=90$ degrees (directly to the right), Gain=1, and no gain adjustment is made to the weaker channel.

In one embodiment, the level of the stronger channel signal can be adjusted by an amount given as $$\text{Gain}=\sin\theta+1.0. \quad (3)$$

Thus, if $\theta=0$ degree (directly in front), Gain=1, and no gain adjustment is made to the stronger channel. If $\theta=90$ degrees (directly to the right), Gain=2, thereby providing a 6 dB gain compensation to roughly match the overall loudness at different values of $\theta$.

If a sound source is substantially stationary or moves substantially within a given hemi-plane, the same filters can be used to generate filter responses. Intensity compensations for weaker and stronger hearing sides can be provided by the IID compensations as described above. If a sound source moves from one hemi-plane to another hemi-plane, however, the filters can also change. Thus, IIDs that are based on the filter levels may not provide compensations in such a way as to make a smooth hemi-plane transition. Such a transition can result in a detectable sudden shift in intensity as the sound source moves between hemi-planes.

Thus, in one embodiment as shown in FIG. 15, the IID component 280 can further include a crossfade component 290 that provides smoother transitions to a new hemi-plane as the source moves from an old hemi-plane to the new one. An example of IID crossfade operation is described below in greater detail.

As shown in FIG. 15, left and right intensity adjusted signals 288 are shown to be output by the IID component 280. As described above, the intensity adjusted signals 288 may or may not be crossfaded. For example, if the source is stationary or moves within a given hemi-plane, there may not be a need to crossfade, since the filters remain substantially the same. If the source moves between hemi-planes, crossfading may be desired to reduce or substantially eliminate sudden shifts in IIDs.

Figure 16:
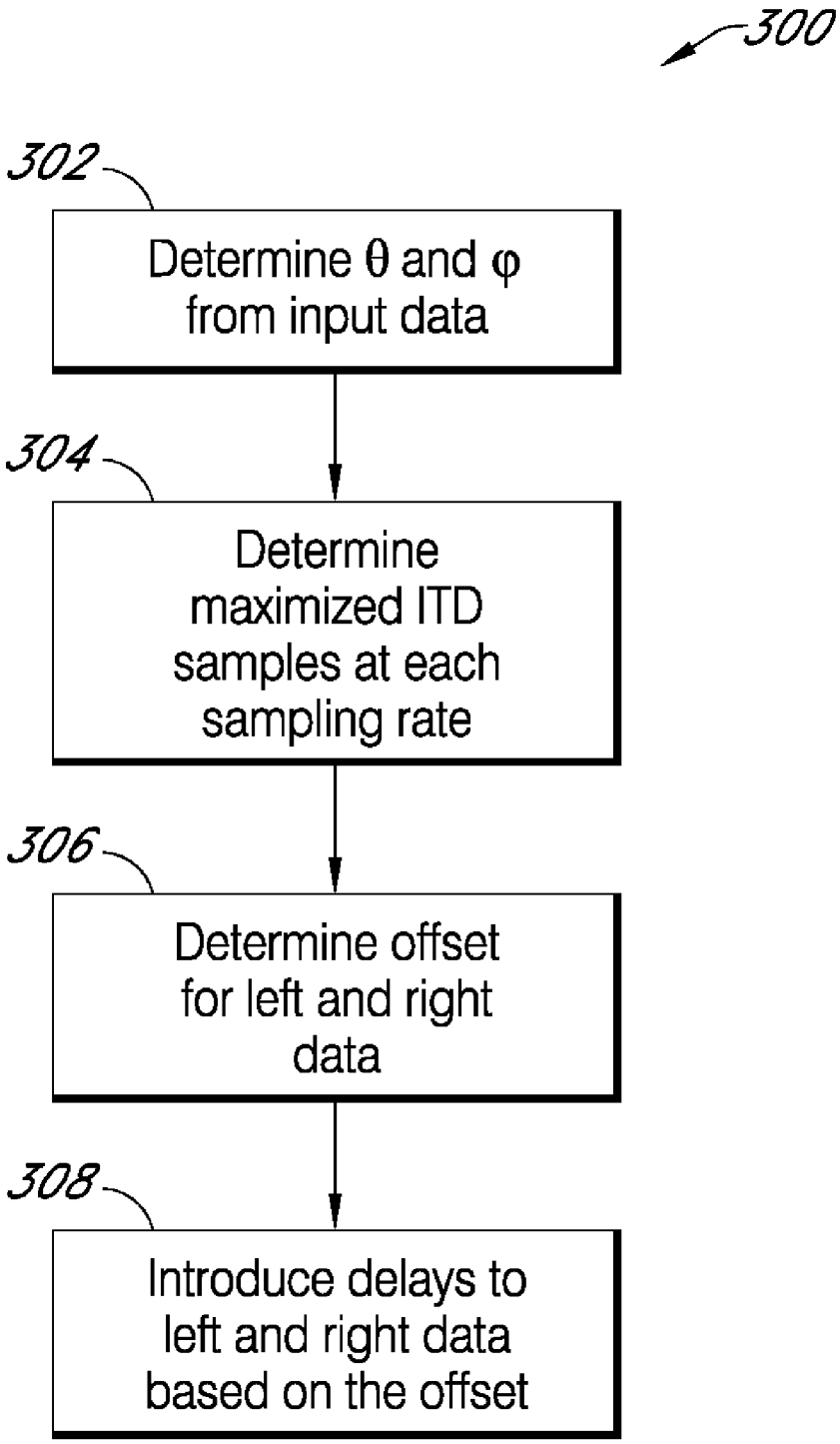
FIG. 16 shows one embodiment of a process that can be performed by the ITD component of FIG. 12.

FIG. 16 shows one embodiment of a process 300 that can be performed by the ITD component described above in reference to FIGS. 12 and 13. In a process block 302, sound source position angles $\theta$ and $\phi$ are determined from input data. In a process block 304, maximized ITD samples are determined for each sampling rate. In a process block 306, ITD offset values for left and right data are determined. In a process block 308, delays corresponding to the ITD offset values are introduced to the left and right data.

In one embodiment, the process 300 can further include a process block where crossfading is performed on the left and right ITD adjusted signals to account for motion of the sound source.

Figure 17:
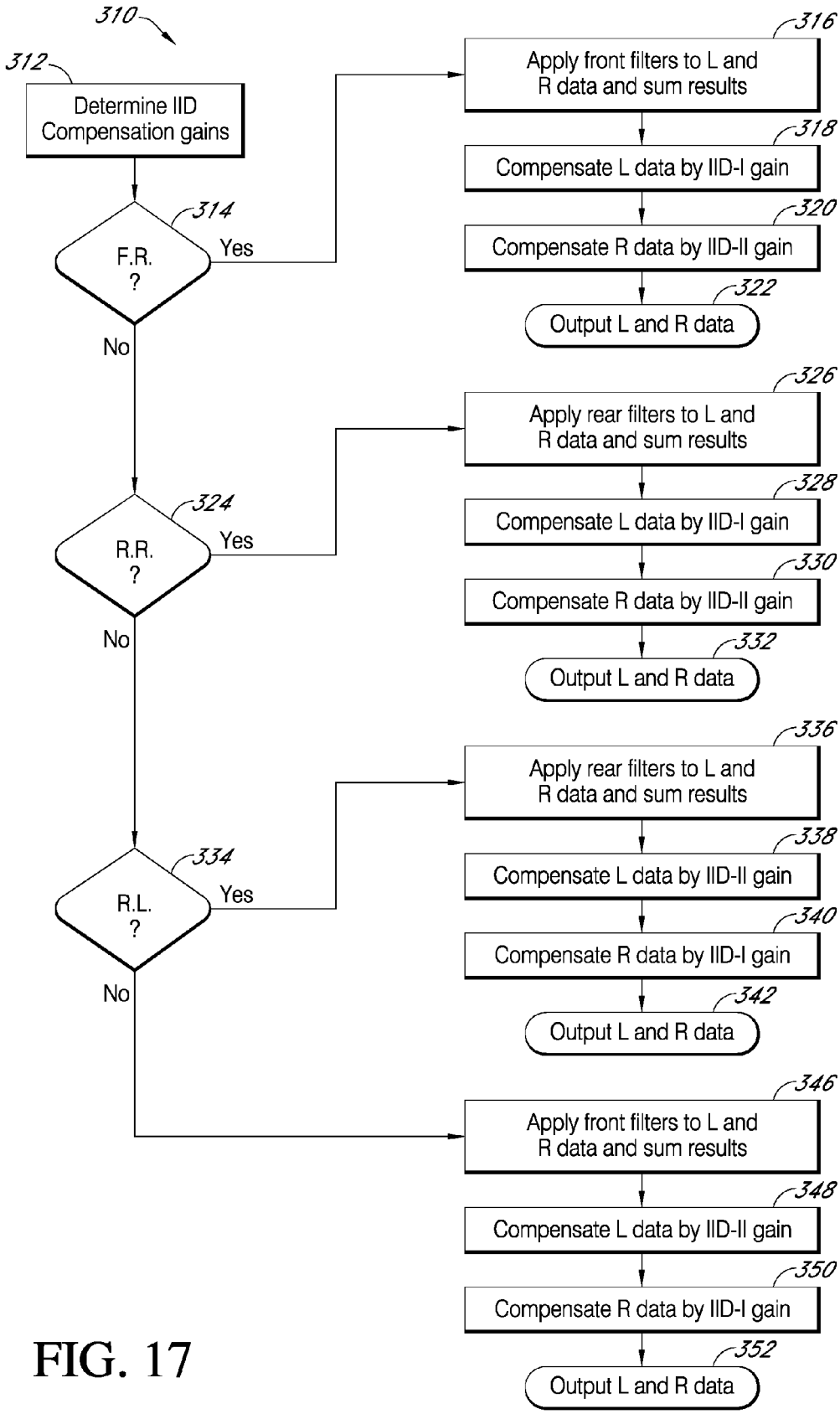
FIG. 17 shows one embodiment of a process that can be performed by the positional filters and IID components of FIG. 12.

FIG. 17 shows one embodiment of a process 310 that can be performed by the positional filters component and/or the IID component described above in reference to FIGS. 12, 14, and 15. In a process block 312, IID compensation gains can be determined. Equations 2 and 3 are examples of such compensation gain calculations.

In a decision block 314, the process 310 determines whether the sound source is at the front and to the right ("F.R."). If the answer is "Yes," front filters (at appropriate elevation) are applied to the left and right data in a process block 316. The filter-applied data and the gain adjusted data are summed to generate position-filters output signals. Because the source is at the right side, the right data is the stronger channel, and the left data is the weaker channel. Thus, in a process block 318, first compensation gain (Equation 2) is applied to the left data. In a process block 320, second compensation gain (Equation 3) is applied to the right data. The position filtered and gain adjusted left and right signals are output in a process block 322.

If the answer to the decision block 314 is "No," the sound source is not at the front and to the right. Thus, the process 310 proceeds to other remaining quadrants.

In a decision block 324, the process 310 determines whether the sound source is at the rear and to the right ("R.R."). If the answer is "Yes," rear filters (at appropriate elevation) are applied to the left and right data in a process block 326. The filter-applied data and the gain adjusted data are summed to generate position-filters output signals. Because the source is at the right side, the right data is the stronger channel, and the left data is the weaker channel. Thus, in a process block 328, first compensation gain (Equation 2) is applied to the left data. In a process block 330, second compensation gain (Equation 3) is applied to the right data. The position filtered and gain adjusted left and right signals are output in a process block 332.

If the answer to the decision block 324 is "No," the sound source is not at F.R. or R.R. Thus, the process 310 proceeds to other remaining quadrants.

In a decision block 334, the process 310 determines whether the sound source is at the rear and to the left ("R.L."). If the answer is "Yes," rear filters (at appropriate elevation) are applied to the left and right data in a process block 336.

The filter-applied data and the gain adjusted data are summed to generate position-filters output signals. Because the source is at the left side, the left data is the stronger channel, and the right data is the weaker channel. Thus, in a process block 338, second compensation gain (Equation 3) is applied to the left data. In a process block 340, first compensation gain (Equation 2) is applied to the right data. The position filtered and gain adjusted left and right signals are output in a process block 342.

If the answer to the decision block 334 is "No," the sound source is not at F.R., R.R., or R.L. Thus, the process 310 proceeds with the sound source considered as being at the front and to the left ("F.L.").

In a process block 346, front filters (at appropriate elevation) are applied to the left and right data. The filter-applied data and the gain adjusted data are summed to generate position-filters output signals. Because the source is at the left side, the left data is the stronger channel, and the right data is the weaker channel. Thus, in a process block 348, second compensation gain (Equation 3) is applied to the left data. In a process block 350, first compensation gain (Equation 2) is applied to the right data. The position filtered and gain adjusted left and right signals are output in a process block 352.

Figure 18:
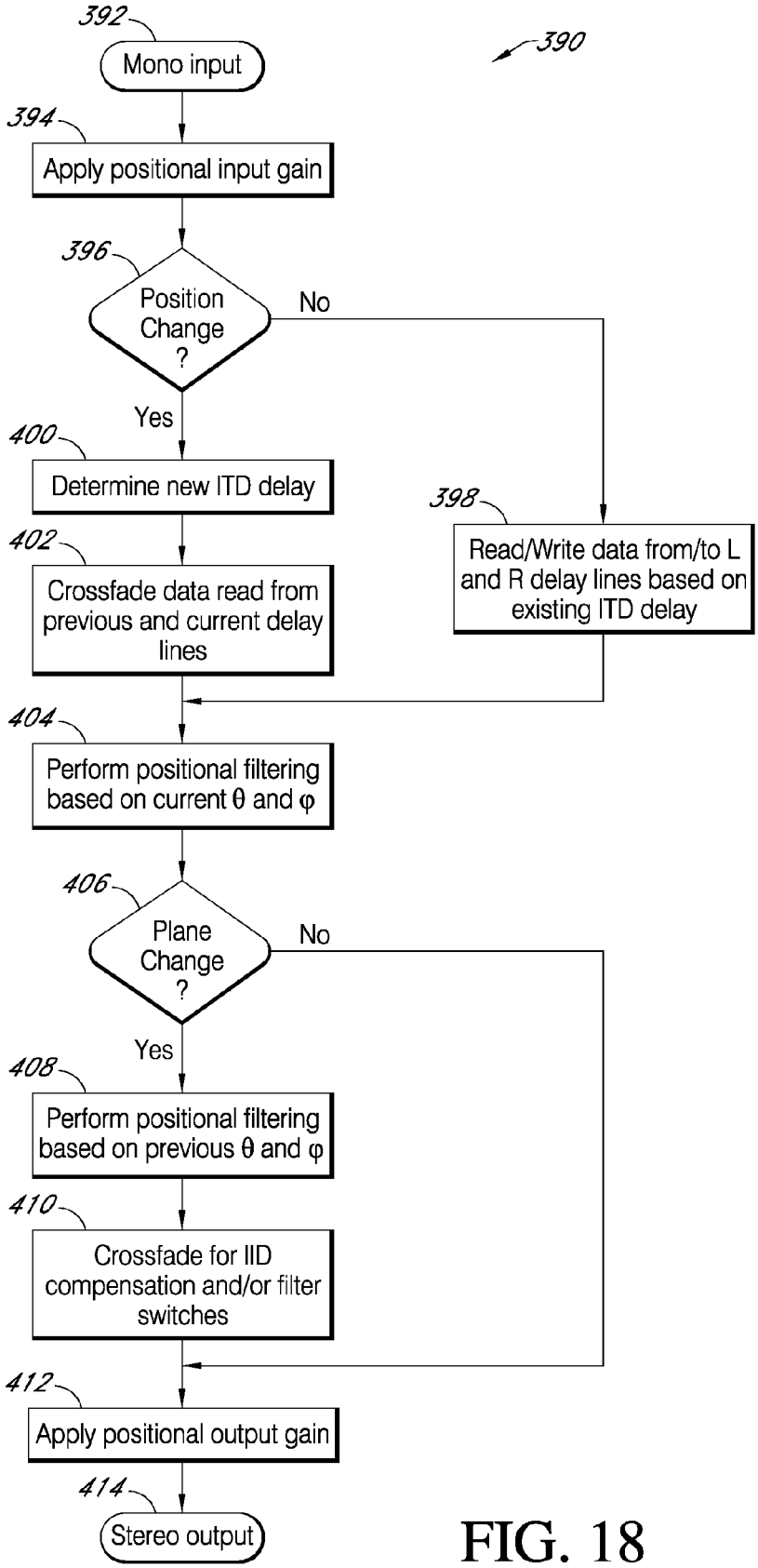
FIG. 18 shows one embodiment of a process that can be performed to provide the functionalities of the ITD, positional filters, and IID components of FIG. 12, where cross-fading functionalities can provide smooth transition of the effects of sound sources that move.

FIG. 18 shows one embodiment of a process 390 that can be performed by the audio signal processing configuration 220 described above in reference to FIGS. 12-15. In particular, the process 390 can accommodate motion of a sound source, either within a hemi-plane, or between hemi-planes.

In a process block 392, mono input signal is obtained. In a process block 392, position-based ITD is determined and applied to the input signal. In a decision block 396, the process 390 determines whether the sound source has changed position. If the answer is "No," data can be read from the left and right delay lines, have ITD delay applied, and written back to the delay lines. If the answer is "Yes," the process 390 in a process block 400 determines a new ITD delay based on the new position. In a process block 402, crossfade can be performed to provide smooth transition between the previous and new ITD delays.

In one embodiment, crossfading can be performed by reading data from previous and current delay lines. Thus, for example, each time the process 390 is called, $\theta$ and $\phi$ values are compared with those in the history to determine whether the source location has changed. If there is no change, new ITD delay is not calculated; and the existing ITD delay is used (process block 398). If there is a change, new ITD delay is calculated (process block 400); and crossfading is performed (process block 402). In one embodiment, ITD crossfading can be achieved by gradually increasing or decreasing the ITD delay value from the previous value to the new value.

In one embodiment, the crossfading of the ITD delay values can be triggered when source's position change is detected, and the gradual change can occur during a plurality of processing cycles. For example, if the ITD delay has an old value $ITD_{old}$, and a new value $ITD_{new}$, the crossfading transition can occur during N processing cycles: $ITD(1)=ITD_{old}$, $ITD(2)=ITD_{old}+\Delta ITD/N, \ldots, ITD(N-1)=ITD_{old}+\Delta ITD(N-1)/N$, $ITD(N)=ITD_{new}$; where $\Delta ITD=ITD_{new}-ITD_{old}$ (assuming that $ITD_{new}>ITD_{old}$).

As shown in FIG. 18, the ITD adjusted data can be further processed with or without ITD crossfading, so that in a process block 404, positional filtering can be performed based on the current values of $\theta$ and $\phi$. For the purpose of description of FIG. 18, it will be assumed that the process block 404 also includes IID compensations.

In a decision block 406, the process 390 determines whether there has been a change in the hemi-plane. If the answer is "No," no crossfading of IID compensations is performed. If the answer is "Yes," the process 390 in a process block 408 performs another positional filtering based on the previous values of $\theta$ and $\phi$. For the purpose of description of FIG. 18, it will be assumed that the process block 408 also includes IID compensations. In a process block 410, crossfading can be performed between the IID compensation values and/or when filters are changed (for example, when switching filters corresponding to previous and current hemi-planes). Such crossfading can be configured to smooth out glitches or sudden shifts when applying different IID gains, switching of positional filters, or both.

In one embodiment, IID crossfading can be achieved by gradually increasing or decreasing the IID compensation gain value from the previous values to the new values, and/or the filter coefficients from the previous set to the new set. In one embodiment, the crossfading of the IID gain values can be triggered when a change in hemi-plane is detected, and the gradual changes of the IID gain values can occur during a plurality of processing cycles. For example, if a given IID gain has an old value $IID_{old}$, and a new value $IID_{new}$, the crossfading transition can occur during N processing cycles: $IID(1)=IID_{old}$, $IID(2)=IID_{old}+\Delta IID/N, \ldots, IID(N-1)=IID_{old}+\Delta IID(N-1)/N$, $IID(N)=IID_{new}$; where $\Delta IID=IID_{new}-IID_{old}$ (assuming that $IID_{new}>IID_{old}$). Similar gradual changes can be introduced for the positional filter coefficients for crossfading positional filters.

As further shown in FIG. 18, the positional filtered and IID compensated signals, whether or not IID crossfaded, yields output signals that can be amplified in a process block 412 so as to yield a processed stereo output 414.

Figure 19:
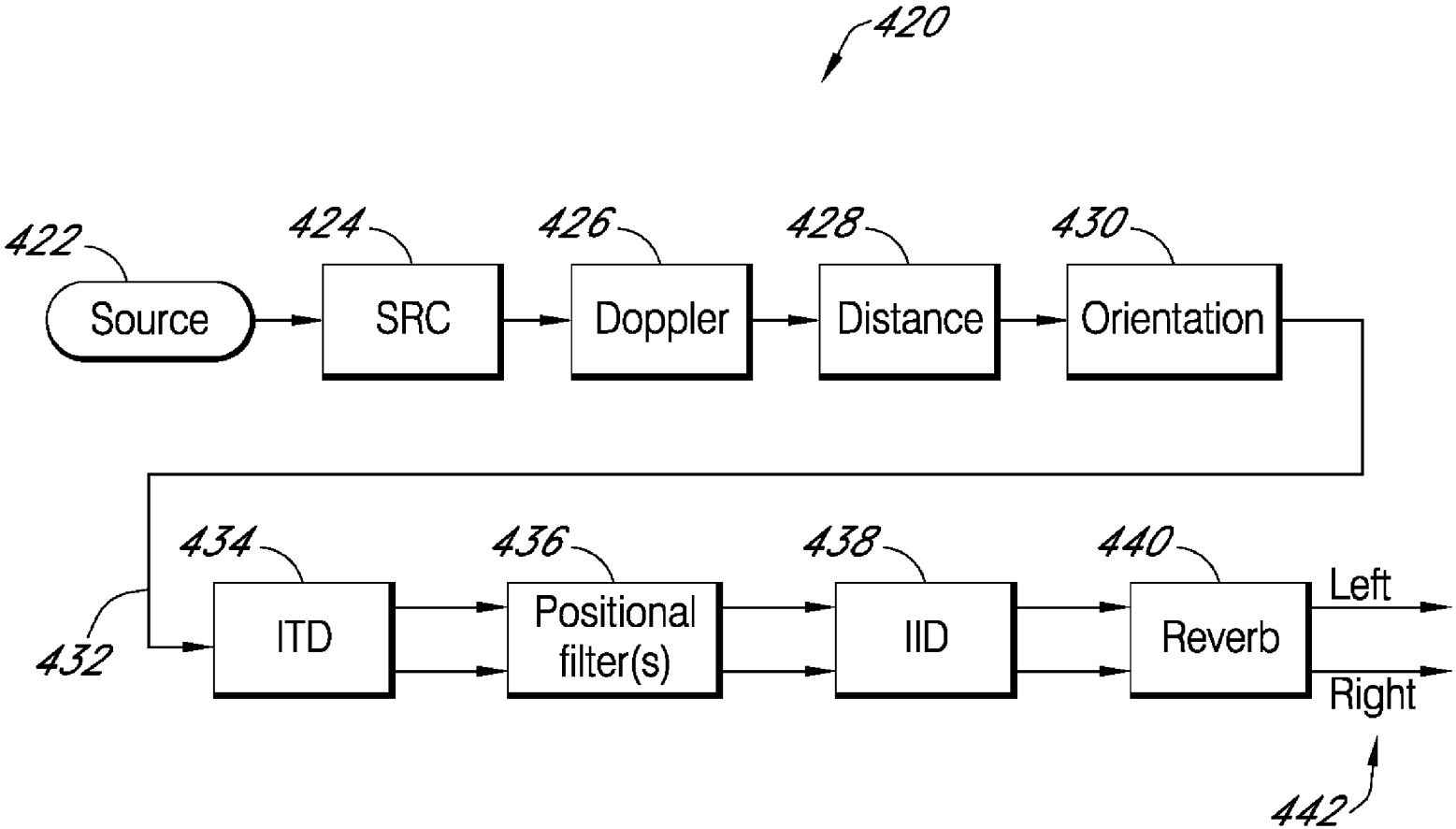
FIG. 19 shows an example signal processing configuration where the positional filters component can be part of a chain with other sound processing components.

In some embodiments, various features of the ITD, ITD crossfading, positional filtering, IID, IID crossfading, or combinations thereof, can be combined with other sound effect enhancing features. FIG. 19 shows a block diagram of one embodiment of a signal processing configuration 420 where sound signal can be processed before and/or after the ITD/positional filtering/IID processing. As shown, sound signal from a source 422 can be processed for sample rate conversion (SRC) 424 and adjusted for Doppler effect 426 to simulate a moving sound source. Effects accounting for distance 428 and the listener-source orientation 430 can also be implemented. In one embodiment, sound signal processed in the foregoing manner can be provided to the ITD component 434 as an input signal 432. ITD processing, as well as processing by the positional-filters 436 and IID 438, can be performed in a manner as described herein.

As further shown in FIG. 19, the output from the IID component 438 can be processed further by a reverberation component 440 to provide reverberation effect in the output signal 442.

In one embodiment, functionalities of the SRC 424, Doppler 426, Distance 428, Orientation 430, and Reverberation 440 components can be based on known techniques; and thus need not be described further.

Figure 20:
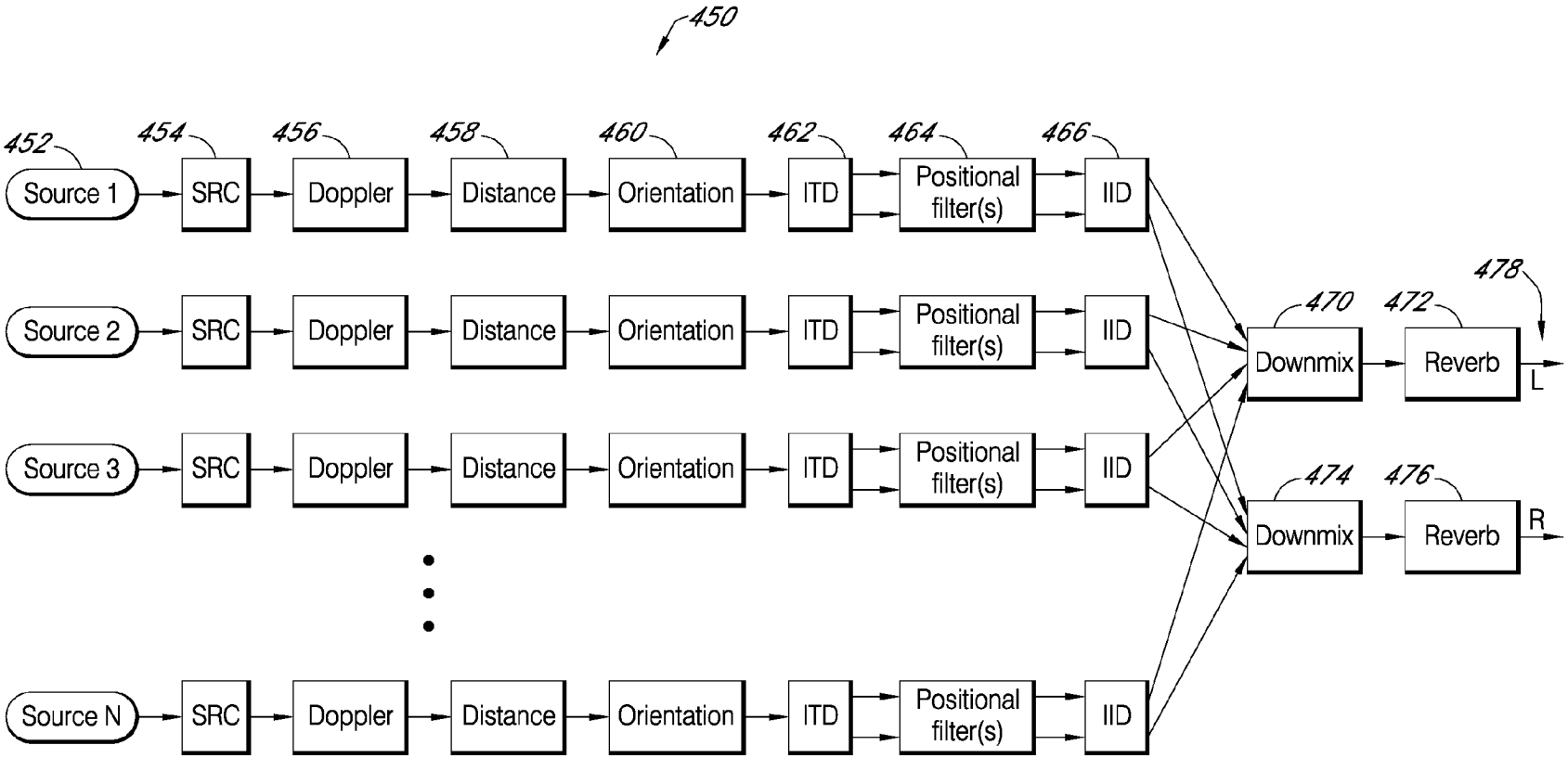
FIG. 20 shows that in one embodiment, a plurality of signal processing chains can be implemented to simulate a plurality of sound sources.

FIG. 20 shows that in one embodiment, a plurality of audio signal processing chains (depicted as 1 to N, with N>1) can process signal from a plurality of sources 452. In one embodiment, each chain of SRC 454, Doppler 456, Distance 458, Orientation 460, ITD 462, Positional filters 464, and IID 466 can be configured similar to the single-chain example 420 of FIG. 19. The left and right outputs from the plurality of IIDs 466 can be combined in respective downmix components 470 and 474, and the two downmixed signals can be reverberation processed (472 and 476) so as to produce output signals 478.

In one embodiment, functionalities of the SRC 454, Doppler 456, Distance 458, Orientation 460, Downmix (470 and 474), and Reverberation (472 and 476) components can be based on known techniques; and thus need not be described further.

Figure 21:
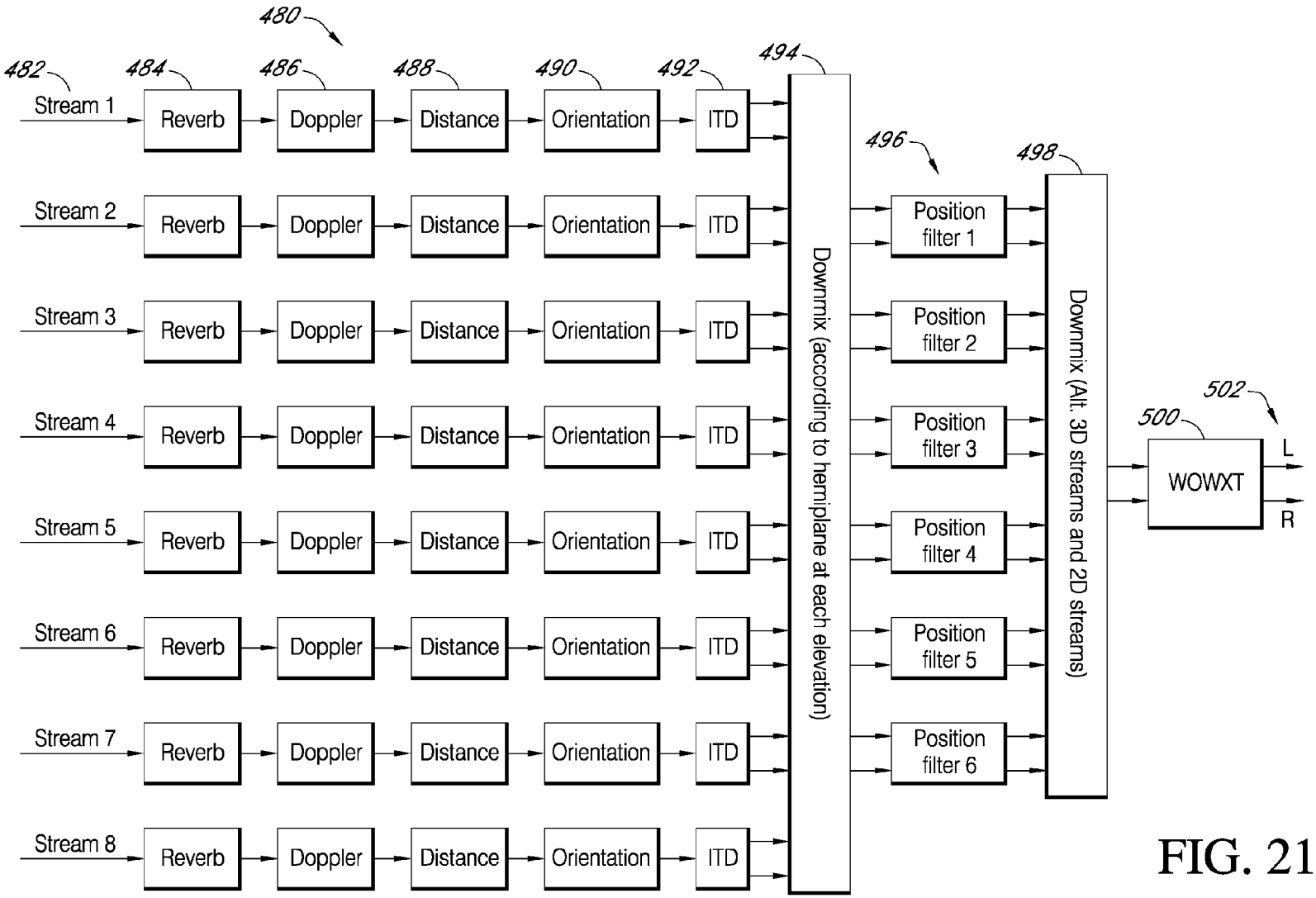
FIG. 21 shows another variation to the embodiment of FIG. 20.

FIG. 21 shows that in one embodiment, other configurations are possible. For example, each of a plurality of sound data streams (depicted as example streams 1 to 8) 482 can be processed via reverberation 484, Doppler 486, distance 488, and orientation 490 components. The output from the orientation component 490 can be input to an ITD component 492 that outputs left and right signals.

As shown in FIG. 21, the outputs of the eight ITDs 492 can be directed to corresponding position filters via a downmix component 494. Six such sets of position filters 496 are depicted to correspond to the six example hemi-planes. The position filters 496 apply their respective filters to the inputs provided thereto, and provide corresponding left and right output signals. For the purpose of description of FIG. 21, it will be assumed that the position filters can also provide the IID compensation functionality.

As shown in FIG. 21, the outputs of the position filters 496 can be further downmixed by a downmix component 498 that mixes 2D streams (such as normal stereo contents) with 3D streams that are processed as described herein. In one embodiment, such downmixing can avoid clipping in audio signals. The downmixed output signals can be further processed by sound enhancing component 500 such as SRS "WOW XT" application to generate the output signals 502.

As seen by way of examples, various configurations are possible for incorporating the features of the ITD, positional filters, and/or IID with various other sound effect enhancing techniques. Thus, it will be understood that configurations other than those shown are possible.

Figure 22A:
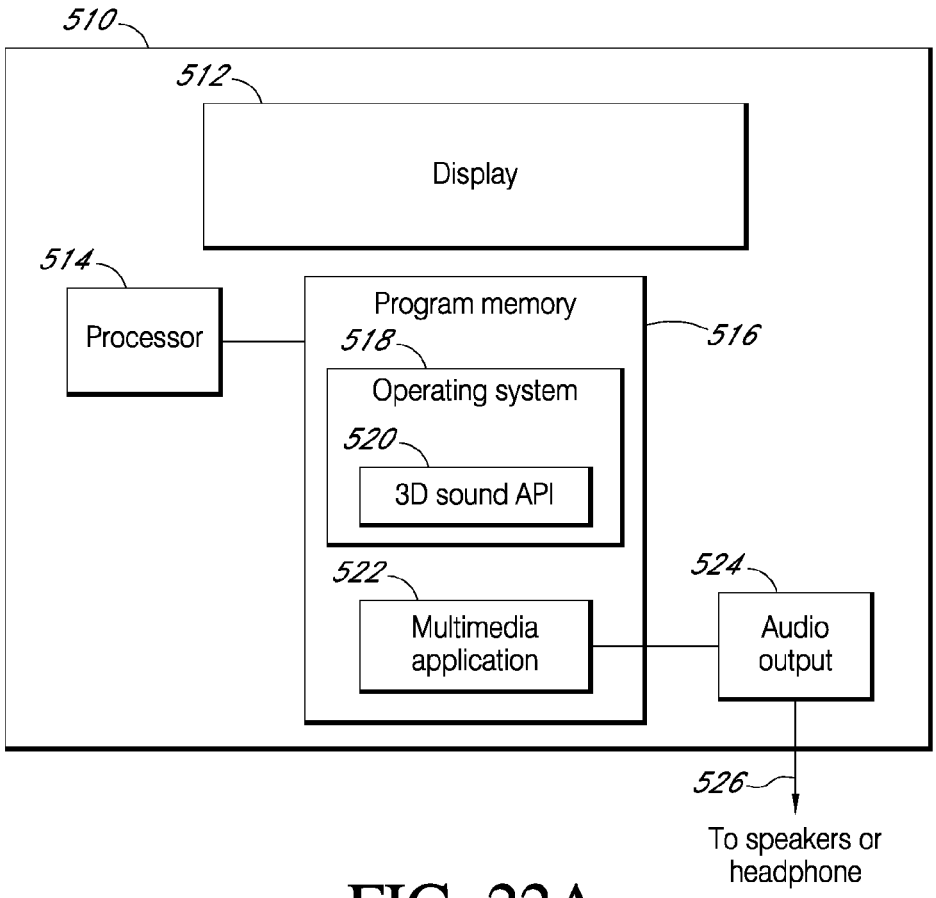
FIGS. 22A and 22B show non-limiting examples of audio systems where the positional audio engine having positional filters can be implemented.
Figure 22B:
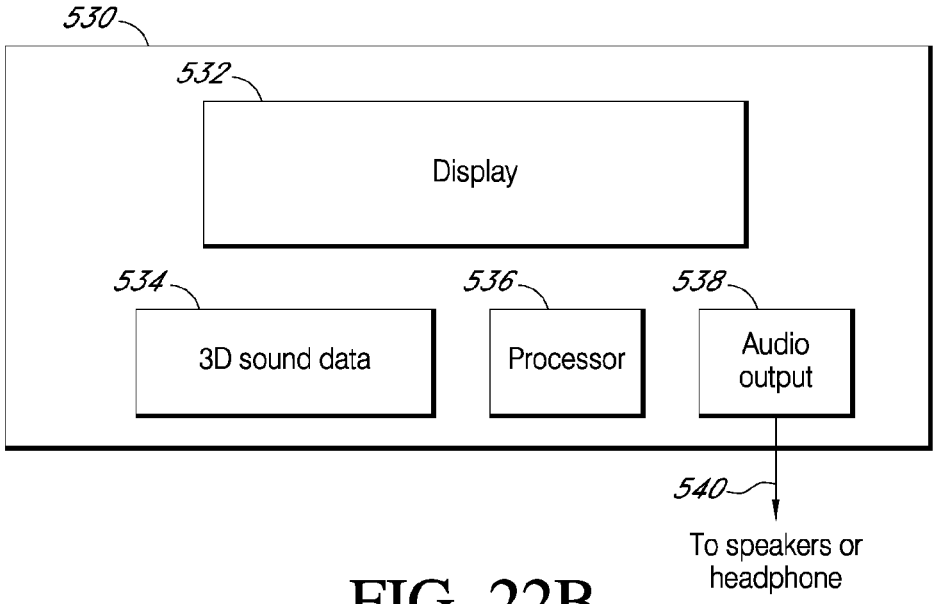

FIGS. 22A and 22B show non-limiting example configurations of how various functionalities of positional filtering can be implemented. In one example system 510 shown in FIG. 22A, positional filtering can be performed by a component indicated as the 3D sound application programming interface (API) 520. Such an API can provide the positional filtering functionality while providing an interface between the operating system 518 and a multimedia application 522. An audio output component 524 can then provide an output signal 526 to an output device such as speakers or a headphone.

In one embodiment, at least some portion of the 3D sound API 520 can reside in the program memory 516 of the system 510, and be under the control of a processor 514. In one embodiment, the system 510 can also include a display 512 component that can provide visual input to the listener. Visual cues provided by the display 512 and the sound processing provided by the API 520 can enhance the audio-visual effect to the listener/viewer.

FIG. 22B shows another example system 530 that can also include a display component 532 and an audio output component 538 that outputs position filtered signal 540 to devices such as speakers or a headphone. In one embodiment, the system 530 can include an internal, or access, to data 534 that have at least some information needed to for position filtering. For example, various filter coefficients and other information may be provided from the data 534 to some application (not shown) being executed under the control of a processor 536. Other configurations are possible.

As described herein, various features of positional filtering and associated processing techniques allow generation of realistic three-dimensional sound effect without heavy computation requirements. As such, various features of the present disclosure can be particularly useful for implementations in portable devices where computation power and resources may be limited.

Figure 23A:
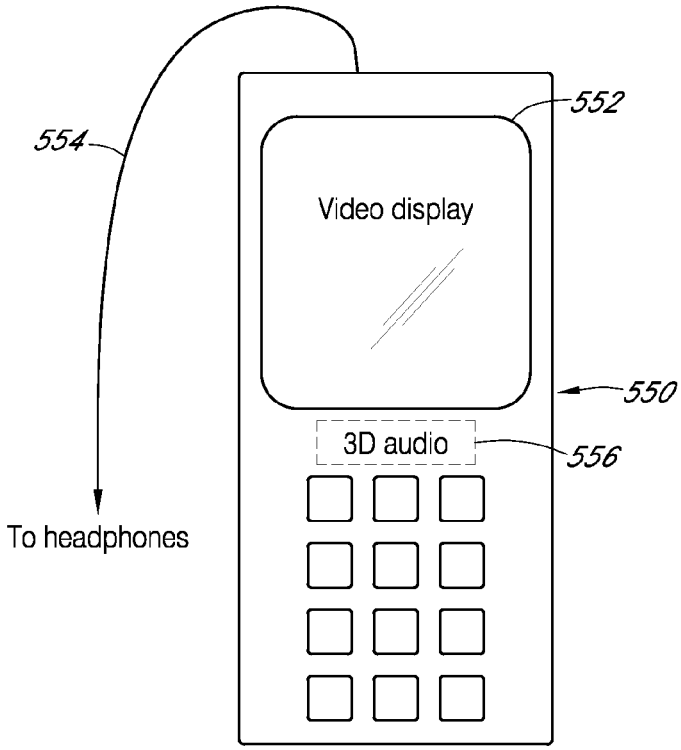
FIGS. 23A and 23B show non-limiting examples of devices where the functionalities of the positional filters can be implemented to provide enhanced listening experience to a listener.
Figure 23B:
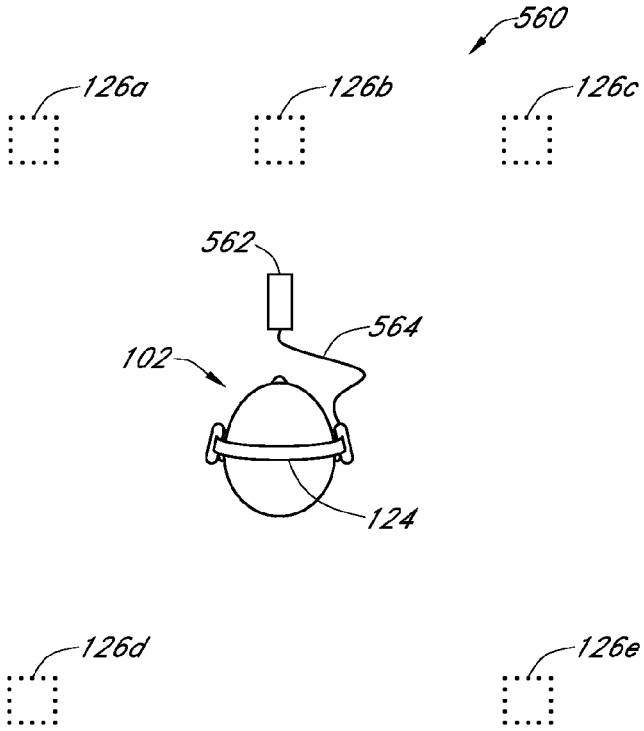

FIGS. 23A and 23B show non-limiting examples of portable devices where various functionalities of positional-filtering can be implemented. FIG. 23A shows that in one embodiment, the 3D audio functionality 556 can be implemented in a portable device such as a cell phone 550. Many cell phones provide multimedia functionalities that can include a video display 552 and an audio output 554. Yet, such devices typically have limited computing power and resources. Thus, the 3D audio functionality 556 can provide an enhanced listening experience for the user of the cell phone 550.

FIG. 23B shows that in another example implementation 560, surround sound effect can be simulated (depicted by simulated sound sources 126) by positional-filtering. Output signals 564 provided to a headphone 124 can result in the listener 102 experiencing surround-sound effect while listening to only the left and right speakers of the headphone 124.

For the example surround-sound configuration 560, positional-filtering can be configured to process five sound sources (for example, five processing chains in FIG. 20 or 21). In one embodiment, information about the location of the sound sources (for example, which of the five simulated speakers) can be encoded in the input data. Since the five speakers 126 do not move relative to the listener 102, positions of five sound sources can be fixed in the processing. Thus, ITD determination can be simplified; ITD crossfading can be eliminated; filter selection(s) can be fixed (for example, if the sources are placed on the horizontal plane, only the front and rear horizontal hemi-planes need to be used); IID compensation can be simplified; and IID crossfading can be eliminated.

Other implementations on portable as well as non-portable devices are possible.

In the description herein, various functionalities are described and depicted in terms of components or modules. Such depictions are for the purpose of description, and do not necessarily mean physical boundaries or packaging configurations. For example, FIG. 12 (and other Figures) depicts ITD, Positional Filters, and IID as components. It will be understood that the functionalities of these components can be implemented in a single device/software, separate devices/softwares, or any combination thereof. Moreover, for a given component such as the Positional Filters, its functionalities can be implemented in a single device/software, plurality of devices/softwares, or any combination thereof.

In general, it will be appreciated that the processors can include, by way of example, computers, program logic, or other substrate configurations representing data and instructions, which operate as described herein. In other embodiments, the processors can include controller circuitry, processor circuitry, processors, general purpose single-chip or multi-chip microprocessors, digital signal processors, embedded microprocessors, microcontrollers and the like.

Furthermore, it will be appreciated that in one embodiment, the program logic may advantageously be implemented as one or more components. The components may advantageously be configured to execute on one or more processors. The components include, but are not limited to, software or hardware components, modules such as software modules, object-oriented software components, class components and task components, processes methods, functions, attributes, procedures, subroutines, segments of program code, drivers, firmware, microcode, circuitry, data, databases, data structures, tables, arrays, and variables.

Although the above-disclosed embodiments have shown, described, and pointed out the fundamental novel features of the invention as applied to the above-disclosed embodiments, it should be understood that various omissions, substitutions, and changes in the form of the detail of the devices, systems, and/or methods shown may be made by those skilled in the art without departing from the scope of the invention. Consequently, the scope of the invention should not be limited to the foregoing description, but should be defined by the appended claims.

What is claimed is:

1. A method for processing digital audio signals, the method comprising:

by one or more processors:

receiving one or more digital signals, each of said one or more digital signals having information about a first spatial position of a sound source relative to a listener;

adjusting the one or more digital signals for interaural time difference (ITD) based at least in part on the first spatial position of the sound source relative to the listener, the adjusting comprising determining a first time difference value based on the first spatial position and introducing the time difference value into the one or more digital signals to produce first left and first right signals, wherein said first time difference value comprises a quantity that is proportional to an absolute value of $\sin\theta\cos\phi$, where $\theta$ represents an azimuthal angle of said sound source relative to the front of said listener, and $\phi$ represents an elevation angle of said sound source relative to a horizontal plane defined by said listener's ears and the front direction;

in response to a change in the first spatial position of the sound source relative to the listener to a second spatial position of the sound source relative to the listener, calculating a second time difference value based on the changed spatial position of the sound source relative to the listener, and transitioning between the first time difference value and the second time difference value to produce second left and right signals by changing the first time difference value to the second time difference value over a plurality of processing cycles;

adjusting each of said second left and right signals for interaural intensity difference (IID) to produce third left and right signals, said adjusting for IID comprising:

determining whether said sound source is positioned at left or right relative to said listener, assigning as a weaker signal the second left or right signal that is on the opposite side as the sound source, assigning as a stronger signal the other of the second left or right signal, adjusting said weaker signal by a first compensation, wherein said first compensation comprises a compensation value that is proportional to $\cos\theta$, adjusting said stronger signal by a second compensation wherein said second compensation comprises a compensation value that is proportional to $\sin\theta$, and transitioning said first and second compensation values to new compensation values over a plurality of processing cycles in response to the change in the first spatial position of the sound source to the second spatial position;

selecting one or more digital filters, each of said one or more digital filters being formed from a particular range of a head-related transfer function, the one or more digital filters comprising a digital filter having a first peak at about 4 kHz, a second peak having a lower amplitude than the first peak between about 10 kHz and 11 kHz, a substantially flat response at first frequencies below a frequency of the first peak, and an attenuating response that attenuates second frequencies higher than the second peak; and applying said one or more digital filters to the third left and right signals so as to yield corresponding left and right filtered signals, each of said left and right filtered signals having a simulated effect of said head-related transfer function applied to said sound source.

2. The method of claim 1, wherein said adjustment of said left and right filtered signals for IID is performed when new one or more digital filters are applied to said left and right filtered signals due to selected movements of said sound source.

3. The method of claim 1, further comprising performing at least one of the following processing steps either before said receiving of said one or more digital signals or after said applying of said one or more filters: sample rate conversion, Doppler adjustment for sound source velocity, distance adjustment to account for distance of said sound source to said listener, orientation adjustment to account for orientation of said listener's head relative to said sound source, or reverberation adjustment.

4. The method of claim 1, wherein said application of said one or more digital filters to said one or more digital signals simulates an effect of motion of said sound source about said listener.

5. The method of claim 1, wherein said application of said one or more digital filters to said one or more digital signals simulates an effect of placing said sound source at a selected location about said listener.

6. The method of claim 1, wherein said one or more digital signals comprise left and right digital signals to be output to left and right speakers and said plurality of sound sources comprise more than two sound sources such that effects of more than two sound sources are simulated with said left and right speakers.

7. The method of claim 6, wherein said plurality of sound sources comprise five sound sources arranged in a manner similar to one of surround sound arrangements, and wherein said left and right speakers are positioned in a headphone, such that surround sound effects are simulated by said left and right filtered signals provided to said headphone.

* * * * *

UNITED STATES PATENT AND TRADEMARK OFFICE

CERTIFICATE OF CORRECTION

PATENT NO. : 8,027,477 B2
APPLICATION NO. : 11/531624
DATED : September 27, 2011
INVENTOR(S) : Wang It is certified that error appears in the above-identified patent and that said Letters Patent is hereby corrected as shown below:

Title Page;

Page 1 (Item 57) Abstract at line 11, Change "heating" to --hearing--.

In column 2 (Item 56) page 2 at line 1, Under Other Publications, change "Exper" to --Expert--.

In column 2 (Item 56) page 2 at line 46, Under Other Publications, change "Laoratory," to --Laboratory,--.

In column 2 (Item 56) page 2 at line 46, Under Other Publications, change "Austrailia," to --Australia,--.

Sheet 1 of 18 (Reference Numeral 104) (Fig. 1) at line 1, Change "Postional" to --Positional.--.

Sheet 1 of 18 (Reference Numeral 104) (Fig. 2) at line 1, Change "Postional" to --Positional--.

Sheet 9 of 18 (Reference Numeral 228) (Fig. 12) at line 1, Change "Intesity" to --Intensity--.

In column 23 at line 29, In Claim 1, change " $\cos \phi$ ,," to -- $\cos \phi$, --.

Signed and Sealed this
Seventeenth Day of April, 2012

David J. Kappos

David J. Kappos
*Director of the United States Patent and Trademark Office*